US012446754B2

(12) United States Patent
Park et al.

(10) Patent No.: US 12,446,754 B2
(45) Date of Patent: Oct. 21, 2025

(54) DISHWASHER AND METHOD FOR CONTROLLING SAME

(71) Applicant: SAMSUNG ELECTRONICS CO., LTD., Suwon-si (KR)

(72) Inventors: Jiyong Park, Suwon-si (KR); Byunghwan Ko, Suwon-si (KR); Seunghee Yi, Suwon-si (KR); Jeawon Lee, Suwon-si (KR); Seunggee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 136 days.

(21) Appl. No.: 18/534,096

(22) Filed: Dec. 8, 2023

(65) Prior Publication Data

US 2024/0099546 A1 Mar. 28, 2024

Related U.S. Application Data

(63) Continuation of application No. PCT/KR2022/008755, filed on Jun. 21, 2022.

(30) Foreign Application Priority Data

Jul. 2, 2021 (KR) ..... 10-2021-0086841

(51) Int. Cl.
*A47L 15/30* (2006.01)
*A47L 15/42* (2006.01)

(52) U.S. Cl.
CPC ..... *A47L 15/30* (2013.01); *A47L 15/4234* (2013.01); *A47L 15/4257* (2013.01); *A47L 15/4278* (2013.01); *A47L 2501/14* (2013.01); *A47L 2501/20* (2013.01); *A47L 2501/22* (2013.01)

(58) Field of Classification Search
None
See application file for complete search history.

(56) References Cited

U.S. PATENT DOCUMENTS

| | | | |
|---|---|---|---|
| 1,502,131 | A | 7/1924 | Vaudreuil |
| 3,060,946 | A | 10/1962 | Lantz |
| 5,640,981 | A | 6/1997 | Niemela et al. |
| 5,904,163 | A | 5/1999 | Inoue et al. |
| 6,044,852 | A | 4/2000 | Epperson, Jr. et al. |

(Continued)

FOREIGN PATENT DOCUMENTS

| | | | |
|---|---|---|---|
| CN | 104207745 | A | 12/2014 |
| CN | 104785473 | B | 4/2017 |

(Continued)

OTHER PUBLICATIONS

International Search Report dated Oct. 12, 2022 issued in PCT Application No. PCT/KR2022/008755.

(Continued)

*Primary Examiner* — Rita P Adhlakha
(74) *Attorney, Agent, or Firm* — STAAS & HALSEY LLP

(57) ABSTRACT

A dishwasher according to an embodiment of the disclosure includes a main body, a tub disposed inside the main body, having a washing chamber formed therein, and having an opening at a front side thereof, a basket configured to be rotatable in a first or second direction inside the tub, a driver configured to supply power to rotate the basket, and a door configured to be rotatable in the first direction based on a rotation of the basket in the first direction so as to open or close the opening of the tub.

15 Claims, 26 Drawing Sheets

(56) References Cited

U.S. PATENT DOCUMENTS

| | | | |
|---|---|---|---|
| 6,550,489 | B1 | 4/2003 | Yates |
| 11,172,804 | B2 | 11/2021 | Kim |
| 11,723,511 | B2 | 8/2023 | Woo et al. |
| 2022/0183531 | A1 | 6/2022 | Shin et al. |

FOREIGN PATENT DOCUMENTS

| | | | |
|---|---|---|---|
| CN | 108940958 | A | 12/2018 |
| CN | 211834279 | U | 11/2020 |
| JP | 2021-16774 | | 2/2021 |
| KR | 10-0227175 | | 10/1999 |
| KR | 2001-0001937 | | 1/2001 |
| KR | 20-0338597 | | 1/2004 |
| KR | 10-2006-0010362 | | 2/2006 |
| KR | 10-2007-0102780 | | 10/2007 |
| KR | 10-1930357 | | 12/2018 |
| KR | 10-2020-0012140 | | 2/2020 |
| KR | 10-2021-0039026 | | 4/2021 |

OTHER PUBLICATIONS

Written Opinion dated Oct. 12, 2022 issued in PCT Application No. PCT/KR2022/008755.

FIG. 21

| DRIVER | DOOR | BASKET |
|---|---|---|
| GENERATE ROTATIONAL FORCE IN FIRST DIRECTION | ROTATE IN FIRST DIRECTION | ROTATE IN FIRST DIRECTION |
| GENERATE ROTATIONAL FORCE IN SECOND DIRECTION | - | ROTATE IN SECOND DIRECTION |

DISHWASHER AND METHOD FOR CONTROLLING SAME

CROSS-REFERENCE TO RELATED APPLICATIONS

This is a continuation application of International Application PCT/KR2022/008755, filed Jun. 21, 2022, which is incorporated herein by reference in its entirety, it being further noted that foreign priority benefit is based upon Korean Patent Application No. 10-2021-0086841, filed Jul. 2, 2021, the disclosures of which are incorporated by reference herein in their entirety.

TECHNICAL FIELD

The disclosure relates to a dishwasher with an improved structure and a method of controlling the same.

BACKGROUND ART

In general, a dishwasher includes a main body, a washing tub forming a washing room therein, a basket disposed in the washing tub to hold dishes, a plurality of spray nozzles for spraying water on the dishes contained in the basket, and a sump installed at a bottom of the washing tub to collect washing water and supply to the plurality of spray nozzles. The dishwasher is a device for automatically washing food residues from the dishes using detergent and washing water.

The basket may be provided to be held within the washing room, and water may be sprayed onto the dishes in the basket to perform washing.

However, although a small number of dishes may need to be washed, the washing time may be rather long and a relatively large amount of water may be consumed, so that the dishes may not be washed as quickly as a user desires.

In addition, as a dishwasher becomes larger in size, a larger space may be required to accommodate the dishwasher. Also, additional space may be required in front the dishwasher to open or close a door of the dishwasher.

DISCLOSURE

Technical Problem

The present disclosure is directed to a dishwasher capable of washing a small number of dishes in a short time.

Further, the present disclosure is directed to a dishwasher that does not require a separate installation space by minimizing a size of the dishwasher.

Further, the present disclosure is directed to a dishwasher capable of automatically opening or closing a door of the dishwasher and rotating a basket using a single motor.

Technical Solution

One aspect of the present disclosure provides a dishwasher including a main body, a tub disposed inside the main body. having a washing chamber formed therein, and having an opening at a front side thereof, a basket configured to be rotatable in a first direction or a second direction inside the tub, a driver configured to supply power to rotate the basket, and a door configured to be rotatable in the first direction based on a rotation of the basket in the first direction so as to open or close the opening of the tub.

The dishwasher may further include a clutch device configured to be rotatable inside the tub to selectively transmit a rotational force of the basket to the door.

The clutch device may include a basket rack coupled to the basket to be rotatable, a door rack coupled to the door to be rotatable, and a connection rack coupled to the basket rack to be rotatable together with the basket rack, the connecting rack configured to transmit the rotational force to the door rack in response to the rotating of the basket rack in the first direction and not to transmit the rotational force to the door rack in response to the rotating of the basket rack in the second direction.

The connection rack may include a clutch portion recessed from an outer side of the connection rack such that a distance with the door rack gradually increases along the first direction, the clutch portion being provided with a friction bearing transmitting the rotational force to the door rack by friction.

The dishwasher may further include an interference protrusion protruding towards a side of the door rack to be accommodated in a cutout portion of the tub so as to prevent the door from rotating in the second direction.

The interference protrusion may include a rack interference portion configured to interfere with the cutout portion of the tub, and a rack slide portion inclined with respect to a radial direction of the door rack. The cutout portion of the tub may include a tub interference portion configured to interfere with the rack interference portion to prevent the door from rotating in the second direction, and a tub slide portion inclined to come into contact with the rack slide portion and allowing the door to rotate in the first direction.

The dishwasher may further include an inputter configured to receive a user command, a water spray nozzle configured to spray water into the washing chamber and including a nozzle valve to regulate an amount of the water spray, a steam nozzle connected to a pump and configured to spray steam into the washing chamber, and a processor configured to control the nozzle valve and the pump based on the user command received from the inputter.

The user command may include an operation start command. The processor may further control the driver to transmit the rotational force in the first direction to the door based on the operation start command.

The dishwasher may further comprise a hall sensor to detect a position of the door. The processor may identify whether the door closes the tub based on an output of the hall sensor, and control the nozzle valve and the pump to perform a washing process that alternates between a water spraying cycle and a steam spraying cycle in response to the closing of the door.

The processor may control the driver to transmit the rotational force in the second direction to the basket during the water spraying cycle and the steam spraying cycle.

The processor may control the nozzle valve to open the water spray nozzle for a first time in response to the closing of the door, and control the nozzle valve and the pump to alternate between the water spraying cycle and the steam spraying cycle after the first time has elapsed.

The dishwasher may further include a heater connected to the pump, wherein the processor may control the heater to allow a temperature of the heater to reach a set temperature before the first time elapses.

The processor may control the nozzle valve to close the water spray nozzle after the first time has elapsed, and control the pump to perform the steam spraying cycle for a second time based on the closing of the water spray nozzle.

The processor may end the washing process after the water spraying cycle is performed in response to controlling the nozzle valve and the pump to perform the washing process.

The processor may control the driver to transmit the rotational force in the first direction to the door when the washing cycle is complete.

The processor may determine the number of alternating times of the water spraying cycle and the steam spraying cycle based on operation time information received through the inputter.

Another aspect of the present disclosure provides a dishwasher including a main body, a tub disposed inside the main body to form a washing chamber and having an opening at a front side thereof, a basket rotatably provided inside the tub, a driver coupled to the basket to supply power thereto, a door provided to be rotatable in conjunction with rotation of the basket so as to open and close the opening of the tub, a water spray nozzle for spraying water into the washing chamber, and a steam spray nozzle provided to perform a steam spraying cycle that alternates with a water spraying cycle of the water spray nozzle and sprays steam into the washing chamber.

The dishwasher may include a basket rack coupled to the basket to be rotatable in the tub, a door rack coupled to the door to be rotatable in the tub, and a connection rack coupled to the basket rack, the connecting rack selectively connected to the door rack according to a rotation direction of the basket to transmit the rotational force of the basket.

The dishwasher may include a water tank disposed on one side of the tub to store water, a detergent tank disposed on one side of the tub to store detergent, a mixing tank connected to the water tank and the detergent tank to store the water and the detergent in a mixed state, a pump connected to the mixing tank, and a heater for heating a mixture flowing from the pump, and the steam spray nozzle may be provided to spray the steam heated by the heater through the pump.

During the opening and closing process of the door, the basket may rotate in a first direction and the door may be provided to rotate in the first direction in conjunction with the rotation of the basket. During the washing process, the basket may rotate in a second direction and the door may be maintained with the opening closed.

Advantageous Effects

According to various embodiments of the disclosure, the door rotating inside the main body may open or close the washing room, thereby avoiding the need for a separate door opening space for opening or closing the door.

Further, according to various embodiments of the disclosure, the basket rotates during the washing process, thereby effectively washing the dishes in a short time.

Further, according to various embodiments of the disclosure, the door and the basket may be selectively connected by a single drive unit, thereby implementing the dishwasher with a more simplified structure.

Further, according to various embodiments of the disclosure, alternating water and steam spray algorithm may allow the dishes to be washed efficiently in a short time.

DESCRIPTION OF DRAWINGS

FIG. 21 is a view illustrating a case in which the dishwasher controls a driver to transmit a rotational force to the door and a basket according to an embodiment of the disclosure.

MODES OF THE INVENTION

Figure 1:
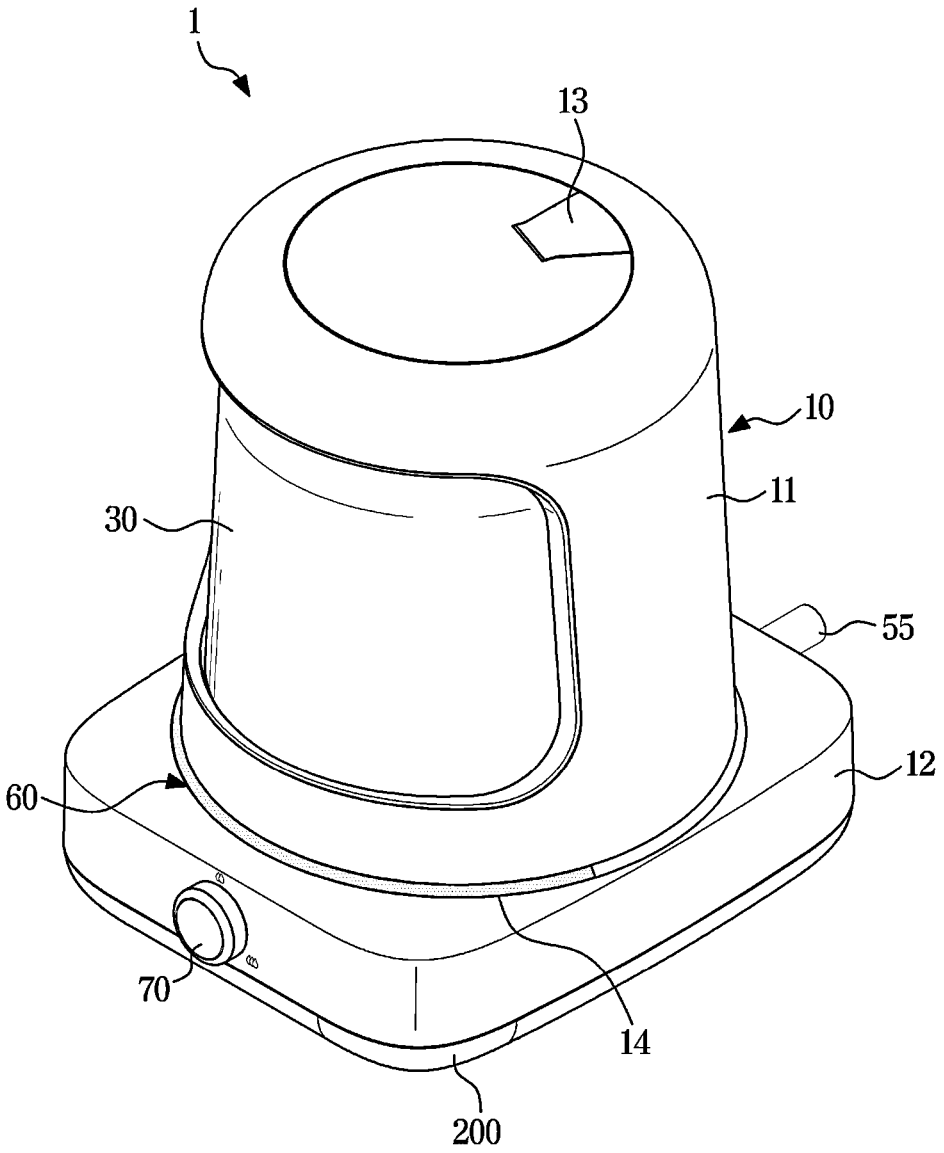
FIG. 1 is a perspective view illustrating a closed state of a door of a dishwasher according to an embodiment of the disclosure.

Embodiments described in the disclosure and configurations shown in the drawings are merely examples of the embodiments of the disclosure and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, numbers, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In addition, the terms, such as "part", "device", "block", "component", "module", and the like may refer to a unit that performs at least one function or operation. For example, these terms may refer to at least one piece of hardware, such as a field-programmable gate array (FPGA)/an application specific integrated circuit (ASIC), at least one piece of software stored in memory, or at least one process performed by a processor.

The designations given to each step are used to identify each step and do not indicate the order in which the steps are to be performed in relation to each other, and each step may be performed in any order other than that specified unless the context clearly indicates a particular order.

Hereinafter, various embodiments according to the disclosure will be described in detail with reference to the accompanying drawings.

Figure 2:
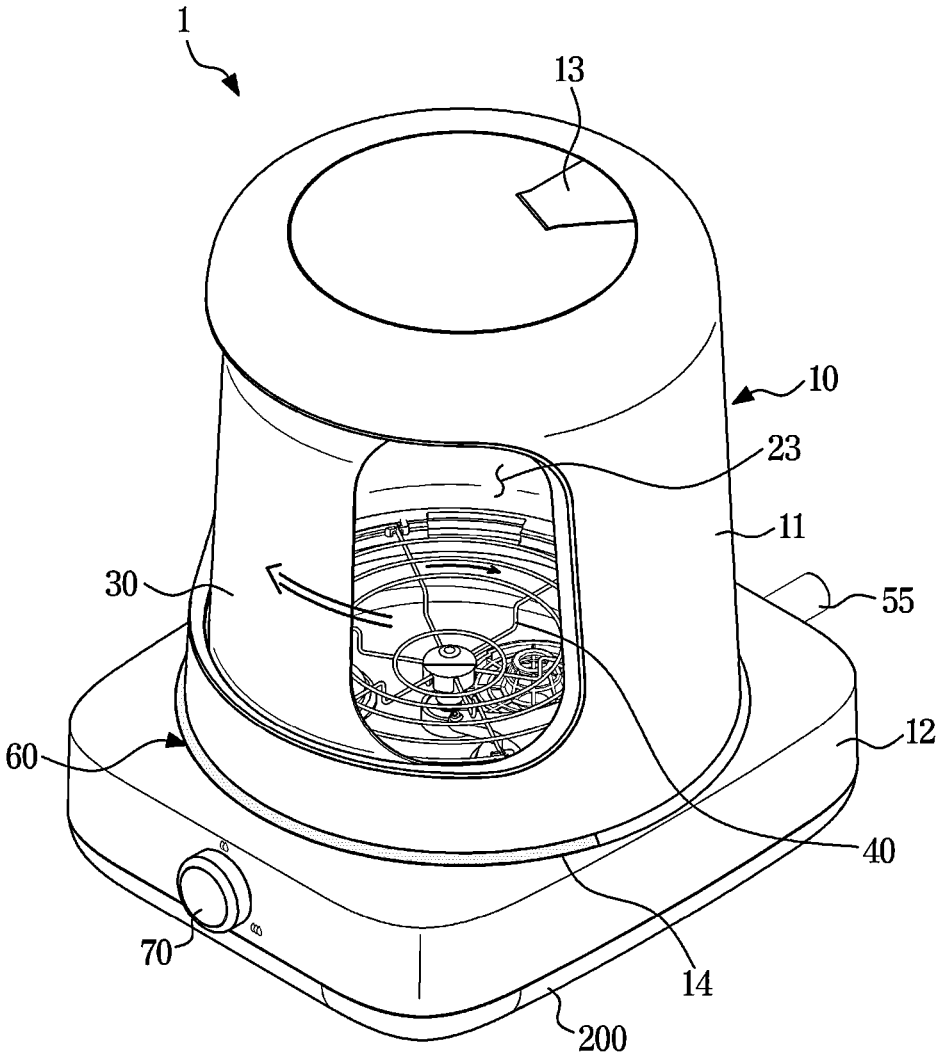
FIG. 2 is a perspective view illustrating an open state of the door of the dishwasher according to an embodiment of the disclosure.

FIG. 1 is a perspective view illustrating a closed state of a door of a dishwasher according to an embodiment of the disclosure. FIG. 2 is a perspective view illustrating an open state of the door of the dishwasher according to an embodiment of the disclosure.

Referring to FIGS. 1 and 2, a dishwasher 1 may include a main body 10 forming an exterior. The dishwasher 1 may include a tub 20 provided inside the main body 10. The tub 20 according to an embodiment of the disclosure may be provided in a substantially cylindrical shape. The tub 20 may be provided to include an opening 21 on a front surface to be open towards a front side thereof.

The dishwasher 1 may include a door 30 provided to open and close the opening 21 of the tub 20. The door 30 may be provided rotatably within the tub 20. The door 30 may be provided in a shape corresponding to the shape of the tub 20. The door 30 may be arranged to rotate together in a first direction based on a first direction rotation of a basket 40. The first direction may refer to a clockwise direction.

The main body 10 may have an open front to correspond to the opening 21 of the tub 20. The main body 10 may include a washing portion 11 formed on an upper side and a base portion 12 formed on a lower side.

The washing portion 11 may be provided in a substantially cylindrical shape, and the base portion 12 may be provided in a substantially square pillar shape. A lighting mounting portion 14 formed by cutting a front side may be provided between the washing portion 11 and the base portion 12. A lighting device 60, which will be described later, may be exposed through the lighting mounting portion 14 to form a portion of the exterior of the main body 10.

The main body 10 may include an inputter 70 provided on a front surface of the base portion 12. A user may control operations of the dishwasher 1 by manipulating the inputter 70. More specifically, the inputter 70 may be provided in the form of a rotatable knob. Accordingly, a cleaning intensity of the dishwasher 1 may vary depending on the degree to which the user rotates the inputter 70. Further details in this regard will be described later.

Figure 3:
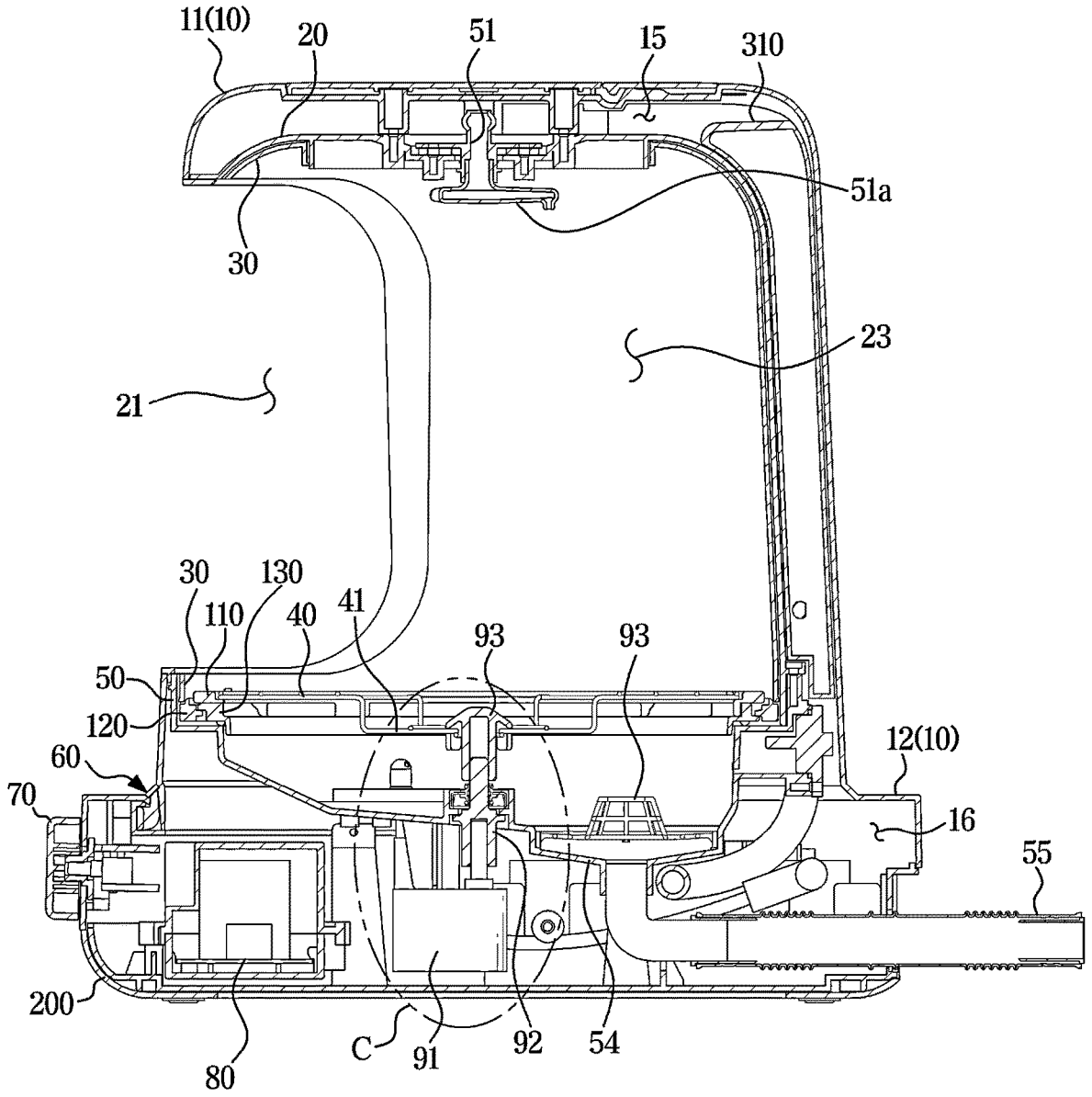
FIG. 3 is a cross-sectional view of the dishwasher of FIG. 1.
Figure 4:
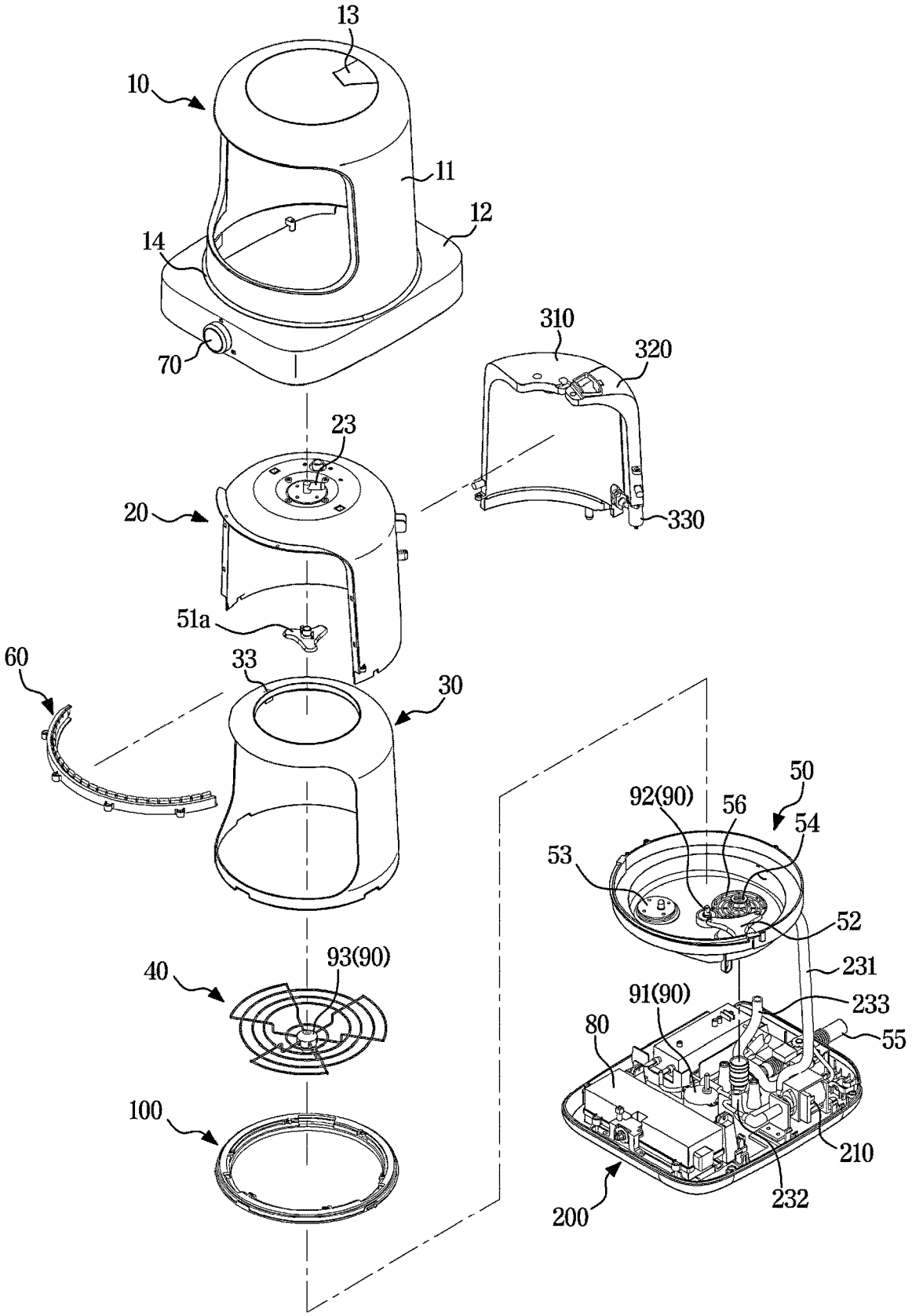
FIG. 4 is an exploded perspective view illustrating the dishwasher according to an embodiment of the disclosure.

FIG. 3 is a cross-sectional view of the dishwasher of FIG. 1. FIG. 4 is an exploded perspective view illustrating the dishwasher according to an embodiment of the disclosure.

As shown in FIG. 3, the dishwasher 1 may be provided with an open front when no dishwashing is being performed. In other words, the door 30 may be provided with the tub 20 open. Accordingly, the user may easily store dishes in a washing chamber 23 through the open front.

The basket 40 may be provided in a lower portion of the washing chamber 23. The basket 40 may have dishes placed on an upper surface thereof and be rotatable within the washing chamber 23. The center of the basket 40 may be connected to a driver 90. The basket 40 may rotate by receiving a rotational force from the driver 90.

The basket 40 may include a basket seating portion 41 that is recessed downwardly from the center. A cylindrical cutlery basket (not shown) or a cup (not shown), which may contain cutlery, etc., may be placed in the basket seating portion 41.

As a result, the cutlery basket (not shown) or the cup (not shown) may be stably supported on the basket 40 while the basket 40 rotates during a washing process. In addition, an edge portion of the cup (not shown), which is prone to contamination, may be washed more thoroughly.

When the door 30 closes an open front surfaces of the tub 20 and the main body 10, the washing process may be performed within the washing chamber 23.

A sump 50 may be disposed below the tub 20. The sump 50 may be provided to collect washing water from which the washing process has been performed and to discharge the collected washing water to a drain pipe 55 through a strainer 56 and a drain nozzle 54.

A mechanical room 16 may be disposed below the sump 50. The mechanical room 16 may be arranged between a base frame 200 and the sump 50. Various components, such as a printed circuit board (PCB) 80, a motor 91, and the like may be mounted in the mechanical room 16.

The dishwasher 1 may include a first water spray nozzle 51 and a first rotation nozzle 51*a* spraying water from an upper portion of the washing chamber 23. Water may be supplied to the first water spray nozzle 51 through a first water supply pipe 231, which will be described later, and spray uniformly into the washing chamber 23 by rotation of the first rotation nozzle 51*a*.

Referring to FIGS. 3 and 4, the main body 10 may include the washing portion 11 and the base portion 12 to form the appearance of the dishwasher 1. A detergent inlet portion 13 may be formed on an upper side of the washing portion 11 to allow the user to refill detergent into a detergent tank 320.

The lighting mounting portion 14 with a partially cut front portion may be provided between the washing portion 11 and the base portion 12. The lighting device 60 may be mounted on the lighting mounting portion 14 to form the exterior of the main body 10.

The lighting device 60 may be provided to indicate the progress of the washing process. The progress of the washing may be indicated by lightening the entirety of the lighting device 60 when the washing process is initiated, and gradually extinguishing the lightened portion as the washing progresses. However, a method of display the lighting device 60 is not limited thereto.

The tub 20 may include the opening 21 corresponding to the open front surface of the main body 10.

The door 30 may be provided in a cylindrical shape, a portion of the door 30 being open so as to be accommodated within the tub 20 and rotatable within the tub 20.

When an opening 32 of the door 30 faces forward, the door 30 may open the opening 21 of the tub 20, and when the opening 32 of the door 30 faces rearward, the door 30 may close the opening 21 of the tub 20.

The basket 40 may be placed on a lower side of the tub 20. The basket 40 is connected to a clutch device 100 provided therebelow to transmit power from the driver 90.

The clutch device 100 may be provided to selectively transmit the rotational force of the basket 40 to the door 30. Further details in this regard will be described later.

The sump 50 may be coupled to a lower portion of the tub 20. A steam nozzle 53, a second water spray nozzle 52, a second rotation nozzle 52*a*, and the drain nozzle 54 may be provided within the sump 50.

The base frame 200 may be coupled to a lower portion of the main body 10. The base frame 200 may be provided to receive the PCB 80, a pump 210, a heater 220, and the driver 90.

The driver 90 may include the motor 91, a motor shaft 92, and a basket shaft 93.

The motor 91 may be provided on an upper portion of the base frame 200 to generate power. The motor shaft 92 may be connected to the motor 91 and provided to penetrate the center of the sump 50. The basket shaft 93 may be coupled to the center of the basket 40 and connected to the motor shaft 92. Accordingly, the power of the driver 90 may be transmitted to the basket 40.

A water tank 310 and the detergent tank 320 may be coupled to the rear of the tub 20. A mixing tank 330 may be provided a lower portion of the detergent tank 320. The water tank 310 may be supplied with water from a third water supply pipe 233. The water tank 310 and the mixing tank 330 may be connected to each other and the detergent tank 320 and the mixing tank 330 may be connected to each other, and thus a mixture of water and detergent may be produced in the mixing tank 330. Further details in this regard will be described later.

Figure 5:
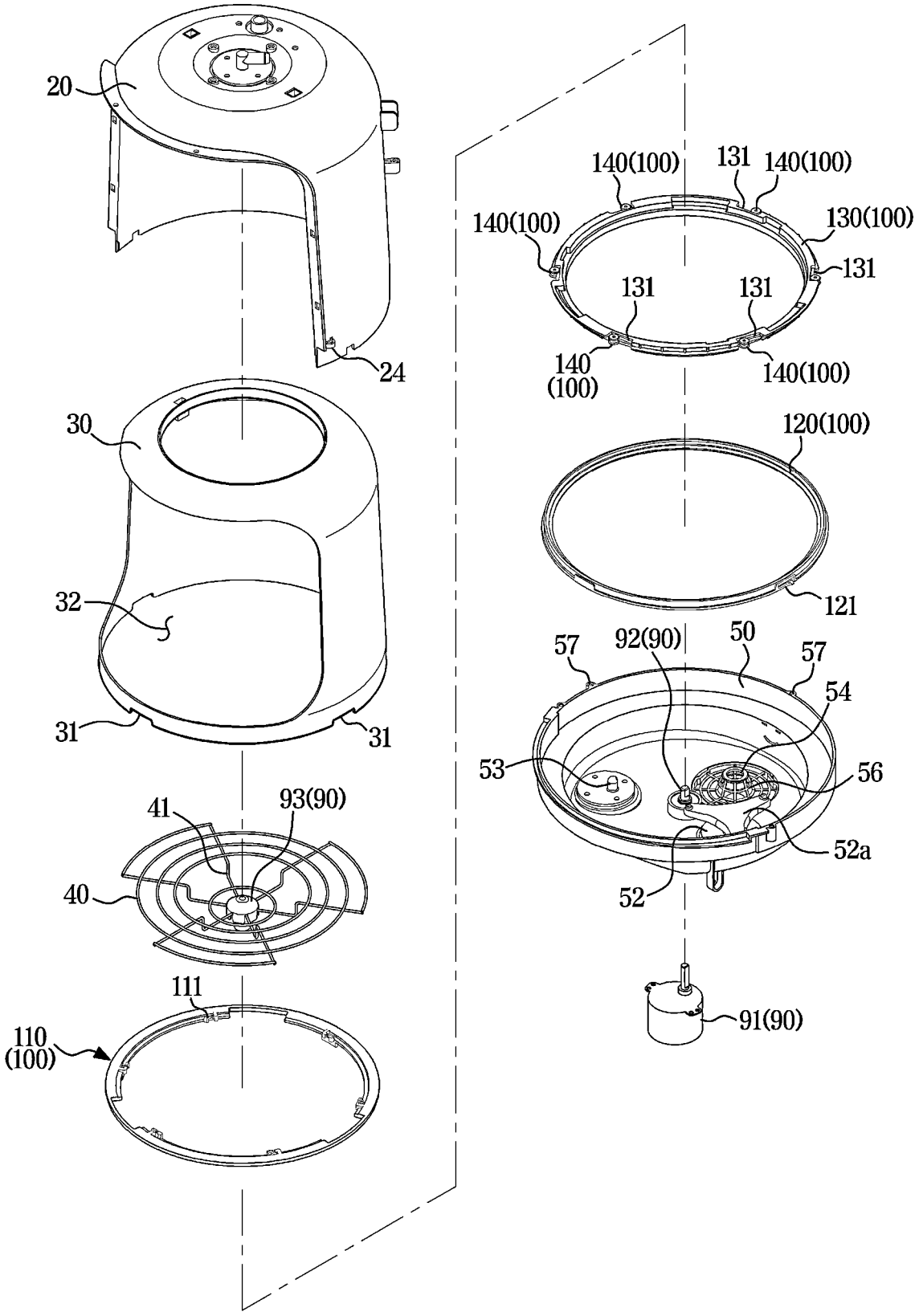
FIG. 5 is an exploded perspective view illustrating a portion of the dishwasher according to an embodiment of the disclosure.
Figure 6:
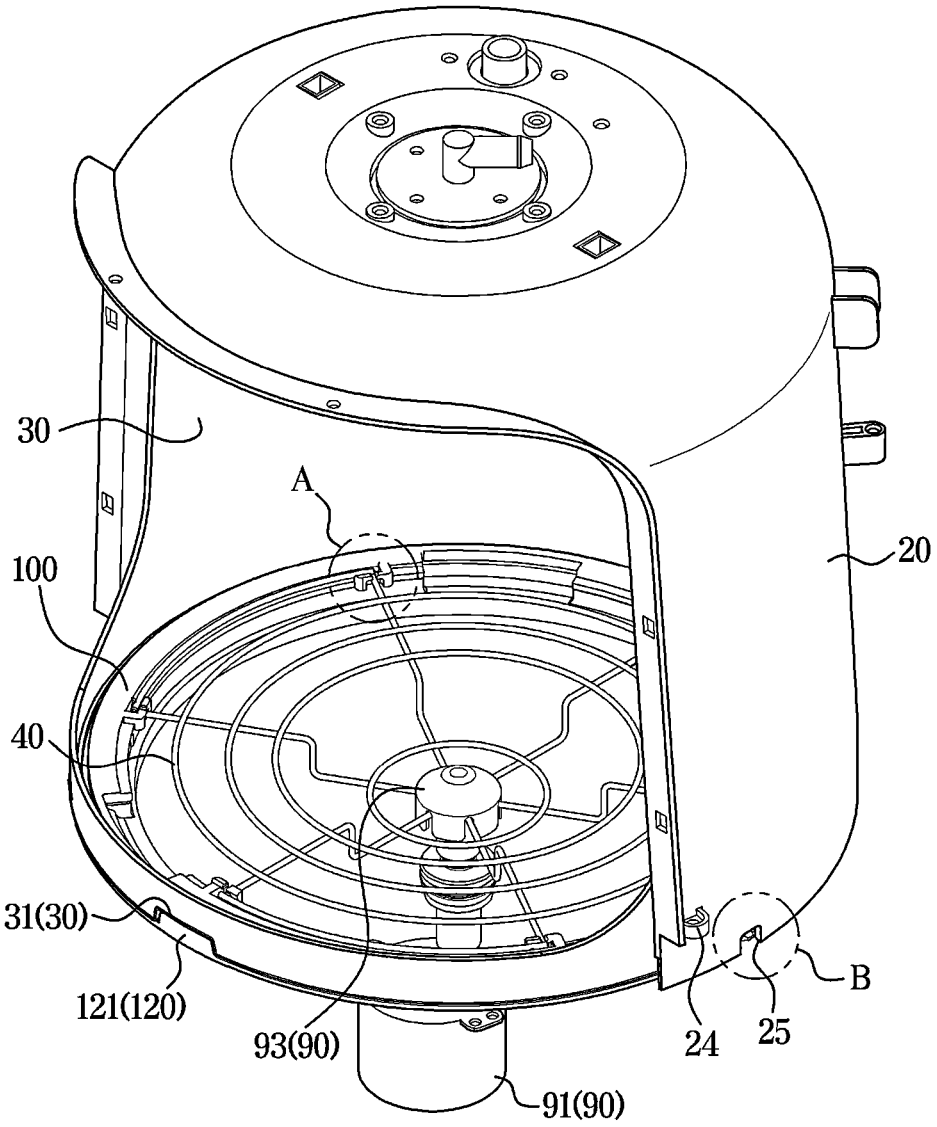
FIG. 6 is a view illustrating a state in which some components shown in FIG. 5 are coupled.

FIG. 5 is an exploded perspective view illustrating a portion of the dishwasher according to an embodiment of the disclosure. FIG. 6 is a view illustrating a state in which some components shown in FIG. 5 are coupled.

As shown in FIGS. 5 and 6, the tub 20 may be connected to the sump 50 to form a space in which the clutch device 100, the basket 40, and the door 30 are accommodated. The tub 20 may include a tub coupling portion 57 protruding outwardly of the tub 20, and a sump coupling portion 24 protruding outwardly of the sump 50.

The tub 20 and the sump 50 may be coupled together by coupling separate fasteners to the tub coupling portion 57 and the sump coupling portion 24.

The clutch device 100 may include a door rack 120, a basket rack 110, and a connection rack 130.

The door 30 may be coupled to the door rack 120. More specifically, a door rack coupling portion 31 may be provided at a lower portion of the door 30. The door rack coupling portion 31 may be provided by cutting a portion of the door 30.

The door rack 120 may include a door insertion portion 121. The door insertion portion 121 may have a shape corresponding to the door rack coupling portion 31 and may be provided to partially protrude in a radial direction of the door rack 120. Accordingly, when the door rack coupling portion 31 is seated on the door insertion portion 121, the rotational force of the door rack 120 may be transmitted to the door 30, so that the door 30 and the door rack 120 may rotate together.

The basket 40 may be coupled to the basket rack 110. The basket rack 110 may include a basket support portion 111. The basket support portion 111 may be provided to allow an end of the basket 40 to be inserted. In response to the basket 40 and the basket rack 110 being coupled, the rotation of the basket 40 may be transmitted to the basket rack 110 to rotate together.

The connection rack 130 may be coupled to the basket rack 110. More specifically, a portion of the basket rack 110 may be inserted into the connection rack 130. Accordingly, the rotation of the basket rack 110 may be transmitted to the connection rack 130.

The connection rack 130 may include a clutch portion 131. The clutch portion 131 may be formed by cutting the connection rack 130 from an outer side to an inner side. The connection rack 130 may be provided to have a radius smaller than that of the door rack 120.

The connection rack 130 may be provided to be rotatable within the door rack 120. Accordingly, the clutch portion 131 may be cut such that a distance with the door rack 120 gradually increases along the first direction. The first direction may be a clockwise direction.

A friction bearing 140 may be disposed in the clutch portion 131. When the friction bearing 140 is disposed in a wide portion of the clutch portion 131, the rotation of the connection rack 130 may not be transmitted to the door rack 120, thereby rotating only the connection rack 130.

Conversely, when the friction bearing 140 is disposed in a narrow portion of the clutch portion 131, the rotation of the connection rack 130 may be transmitted to the door rack 120 by friction, thereby rotating the connection rack 130 and the door rack 120 together. Further details in this regard will be described later.

The driver 90 may generate power. The motor 91 of the driver 90 may be connected to the motor shaft 92 of the sump 50, and the motor shaft 92 may be connected to the basket shaft 93 mounted at the center of the basket 40.

In other words, the power generated by the driver 90 may be transmitted to the basket 40. Thereafter, the basket 40 may transmit a rotational force to the basket rack 110, which is coupled thereto. The basket 40 may be rotatable in either the first direction (i.e., clockwise direction) or the second direction (i.e., counterclockwise direction).

In response to the rotational force being transmitted to the basket rack 110, the rotational force may be transmitted to the connection rack 130 connected to the basket rack 110. The connection rack 130 may also be provided to be rotatable in both the first and second directions.

The connection rack 130 may be provided to transmit the rotational force in the first direction to the door rack 120. Whereas, the connection rack 130 may be provided to prevent the rotational force in the second direction from being transmitted to the door rack 120. This function may be performed by the clutch portion 131 formed on a side portion of the connection rack 130.

The door rack 120 may rotate in the first direction by receiving the rotational force in the first direction of the connection rack 130. The door 30 connected to the door rack 120 may rotate in the first direction accordingly. An opening and closing process of the door 30, in which the opening 21 of the tub 20 is opened and closed as the door 30 rotates, may be performed.

Because the door rack 120 is not allowed to receive the rotational force of the connection rack 130 in the second direction, the door 30 is also not allowed to rotate in the second direction. However, at this time, the basket 40 may be provided to be rotatable in the second direction.

In other words, during the opening and closing process of the door 30, the basket 40 may be provided to rotate in the first direction, and the door 30 may be provided to rotate in the first direction in conjunction with the rotation of the basket 40. In addition, during the washing process, the basket 40 may rotate in the second direction to assist in washing dishes, but the door 30 may be provided to keep the opening 21 of the tub 20 closed. Further details regarding these operations will be described later.

Figure 7:
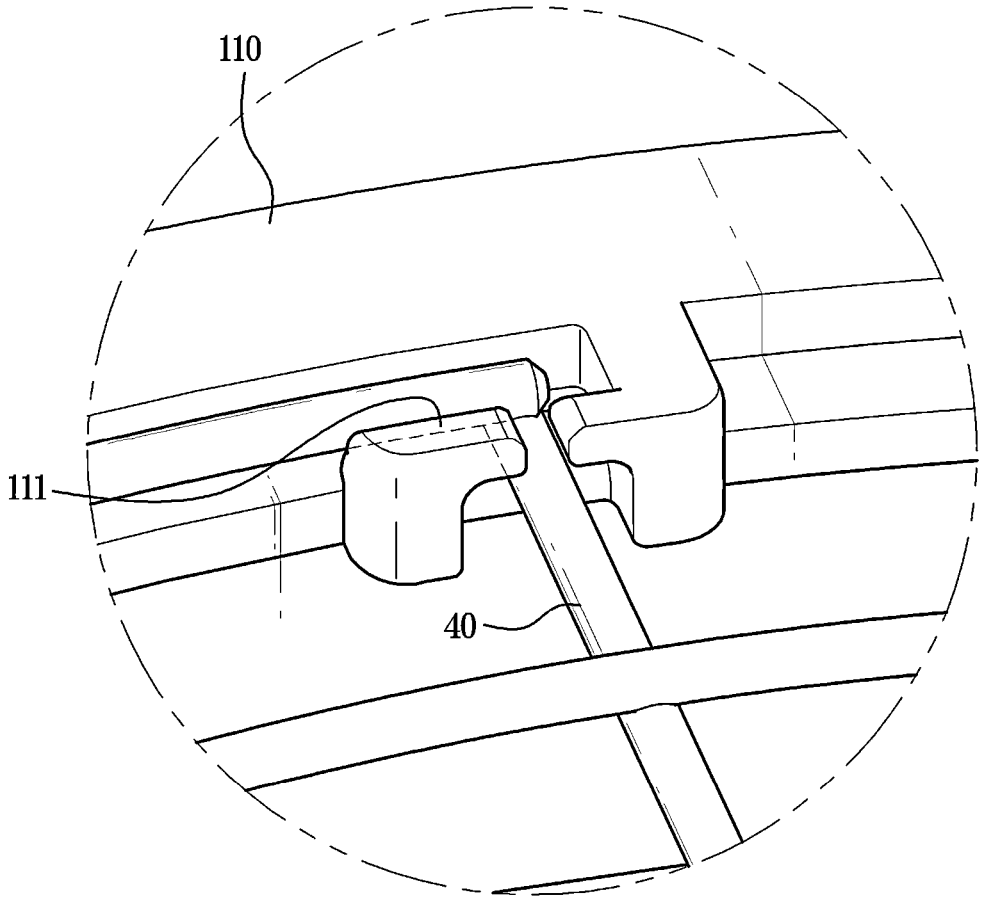
FIG. 7 is an enlarged view illustrating part A of FIG. 6.
Figure 8:
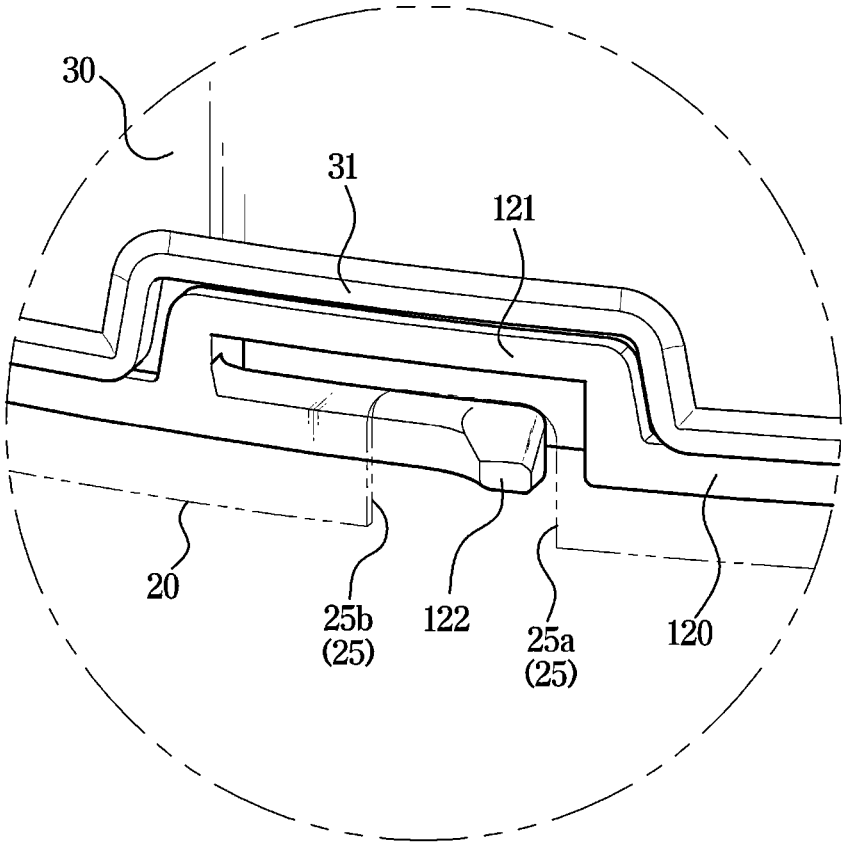
FIG. 8 is an enlarged perspective view illustrating part B of FIG. 6.
Figure 9:
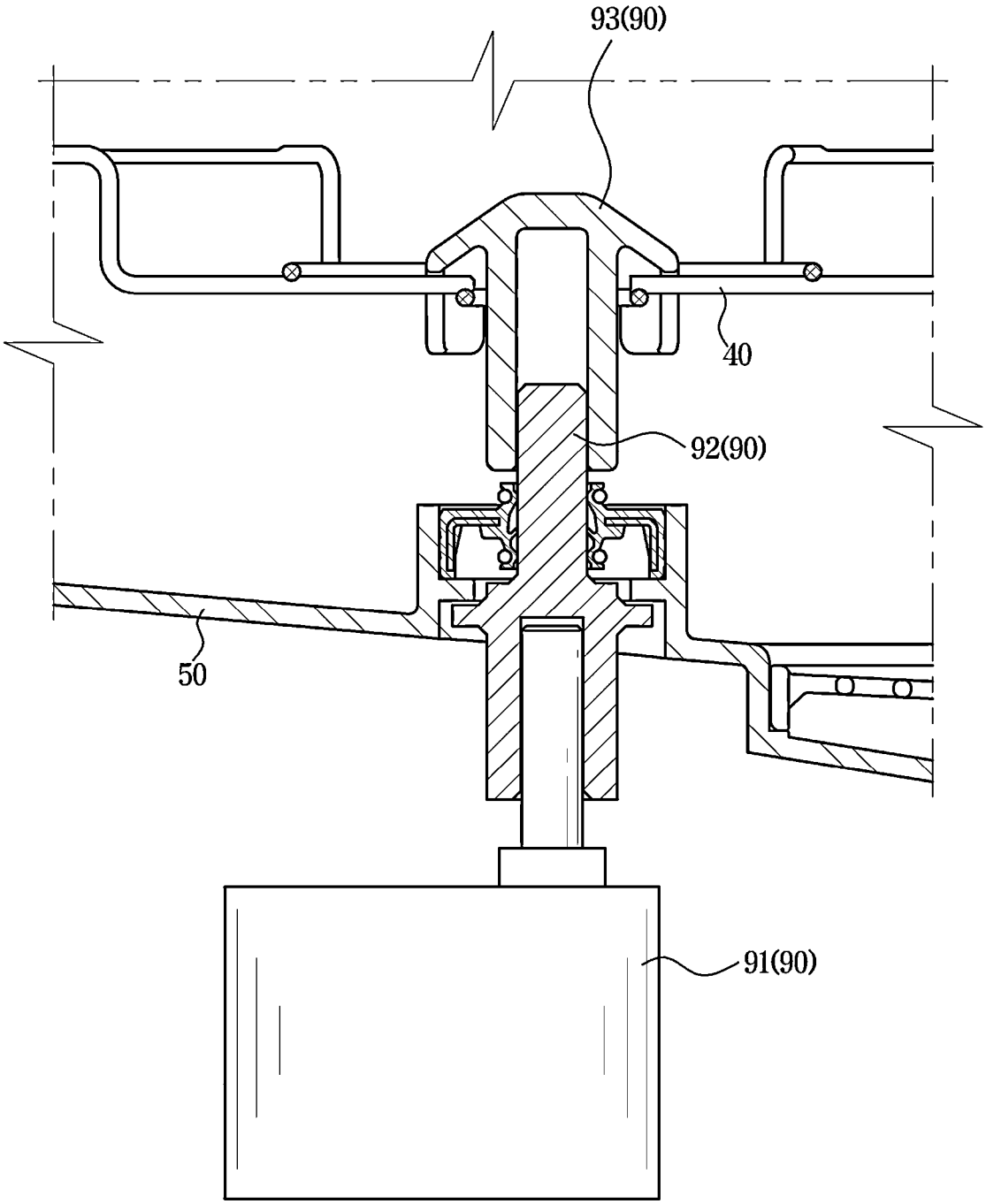
FIG. 9 is an enlarged view illustrating part C of FIG. 3.

FIG. 7 is an enlarged view of part A of FIG. 6. FIG. 8 is an enlarged perspective view of part B of FIG. 6. FIG. 9 is an enlarged view of part C of FIG. 3.

As shown in FIG. 7, the end of the basket 40 may be inserted into the basket support portion 111 formed in the basket rack 110. Accordingly, the rotational force of the basket 40 may be transmitted to the basket rack 110.

As shown in FIG. 8, the door rack coupling portion 31 of the door 30 may be seated on the door insertion portion 121 of the door rack 120. Accordingly, the door 30 may rotate according to the rotation of the door rack 120, which receives the rotational force from the basket rack 110 and the connection rack 130.

As described above, the door 30 may be allowed to rotate only in the first direction and may not be allowed to rotate in the second direction, which may be accomplished by the connection rack 130 selectively transmitting power to the door rack 120.

However, the rotational force in the second direction of the connection rack 130 may be transmitted to the door rack 120 due to incorrect insertion of the friction bearing 140 mounted on the connection rack 130.

At this time, to prevent the rotation of the door rack 120 in the second direction, an interference protrusion 122 may be provided on an outer side of the door rack 120. The interference protrusion 122 may protrude towards the side of the door rack 120 to be accommodated in a cutout portion 25 of the tub 20. The interference protrusion 122 may be made of a material having a certain elasticity.

When the door rack 120 rotates in the first direction, the interference protrusion 122 may slide along a tub slide portion 25*b* of the tub 20 to assist the rotation of the door rack 120 in the first direction. However, when the door rack 120 rotates in the second direction opposite to the first direction, the interference protrusion 122 may interfere with a tub interference portion 25*a* of the tub 20 to prevent the door rack 120 from rotating in the second direction. Further details in this regard will be described later.

As shown in FIG. 9, the driver 90 may include the motor 91, the motor shaft 92, and the basket shaft 93.

The motor 91 may be disposed the lower portion of the sump 50 to supply power. The motor shaft 92 may be disposed within the sump 50. One end of the motor shaft 92 may be coupled to the motor 91 and the other end may be coupled to the basket shaft 93, thereby transmitting power.

The basket shaft 93 may be coupled to the center of the basket 40 to transmit the rotational force to the basket 40.

Figure 10:
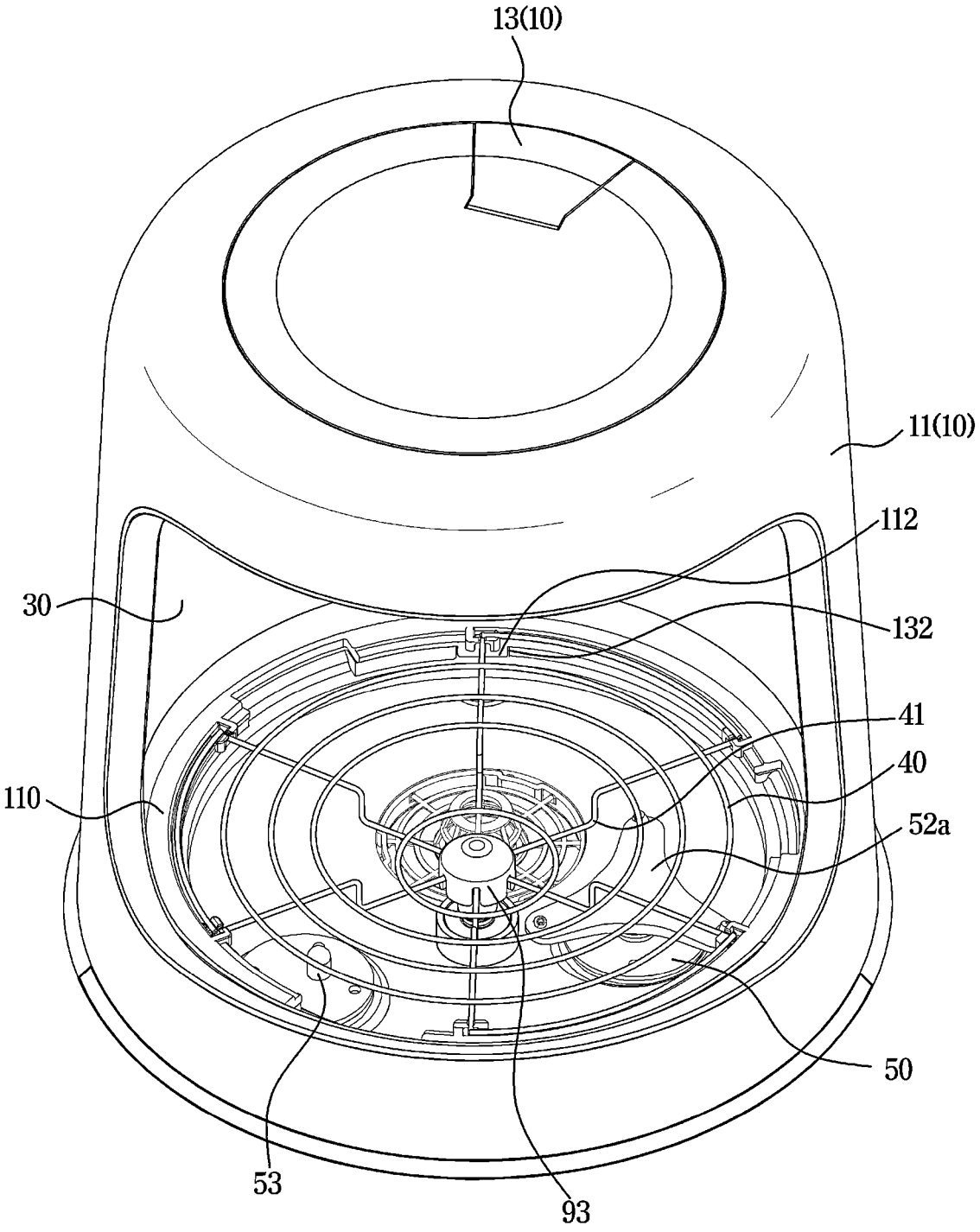
FIG. 10 is a view illustrating an interior of the dishwasher according to an embodiment of the disclosure from the front.

FIG. 10 is a view illustrating the interior of the dishwasher according to an embodiment of the disclosure from the front.

Referring to FIG. 10, the dishwasher 1 may be provided such that the door 30 remains open when in a standby state. Accordingly, the user may easily place dishes in the dishwasher 1.

The door 30 may be provided to rotate within the tub 20 and the main body 10, so the dishwasher 1 may have the same volume even when the door 30 is open. Accordingly, the dishwasher 1 may be easier for the user to use and more space efficient.

The sump 50 may be placed in the lower portion of the washing chamber 23 and the basket 40 may be placed in the upper portion of the sump 50. The outer circumferential surface of the basket 40 may be supported by the basket rack 110. The center of the basket 40 may be supported by the basket shaft 93.

The basket rack 110 may include a connection rack coupling portion 112 extending downward. The connection rack coupling portion 112 may be inserted into a basket rack insertion portion 132 formed in the connection rack 130. Accordingly, the rotation of the basket rack 110 may be transmitted to the connection rack 130.

The sump 50 may be provided with the steam nozzle 53, the second water spray nozzle 52, and the drain nozzle 54.

Steam may be sprayed into the washing chamber 23 by the steam nozzle 53, and water may be sprayed into the washing chamber 23 by the second water spray nozzle 52. Further details regarding a process of the steam nozzle 53 and the water spray nozzles 51 and 52 will be described later.

Figure 11:
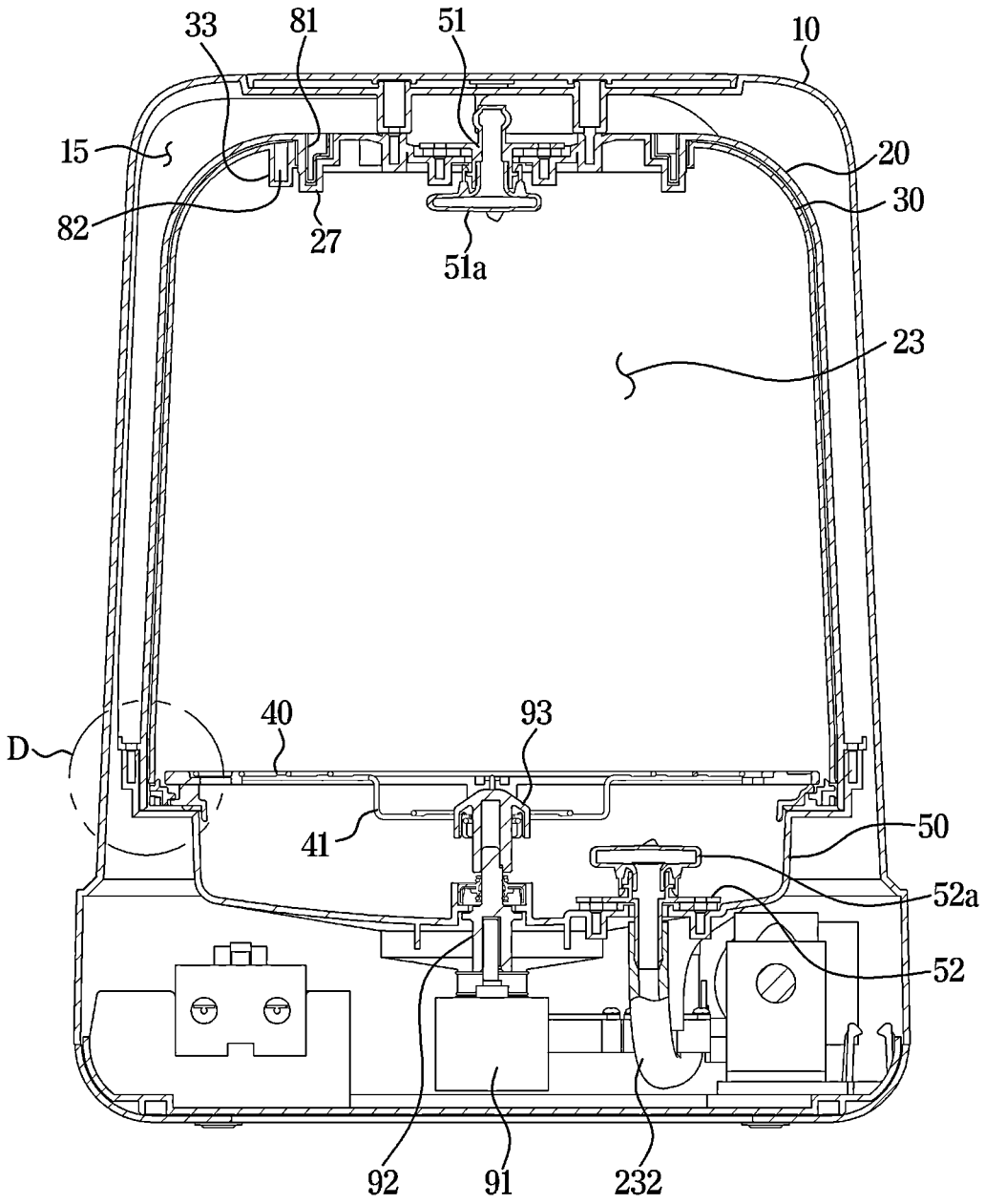
FIG. 11 is a cross-sectional view illustrating the dishwasher according to an embodiment of the disclosure.
Figure 12:
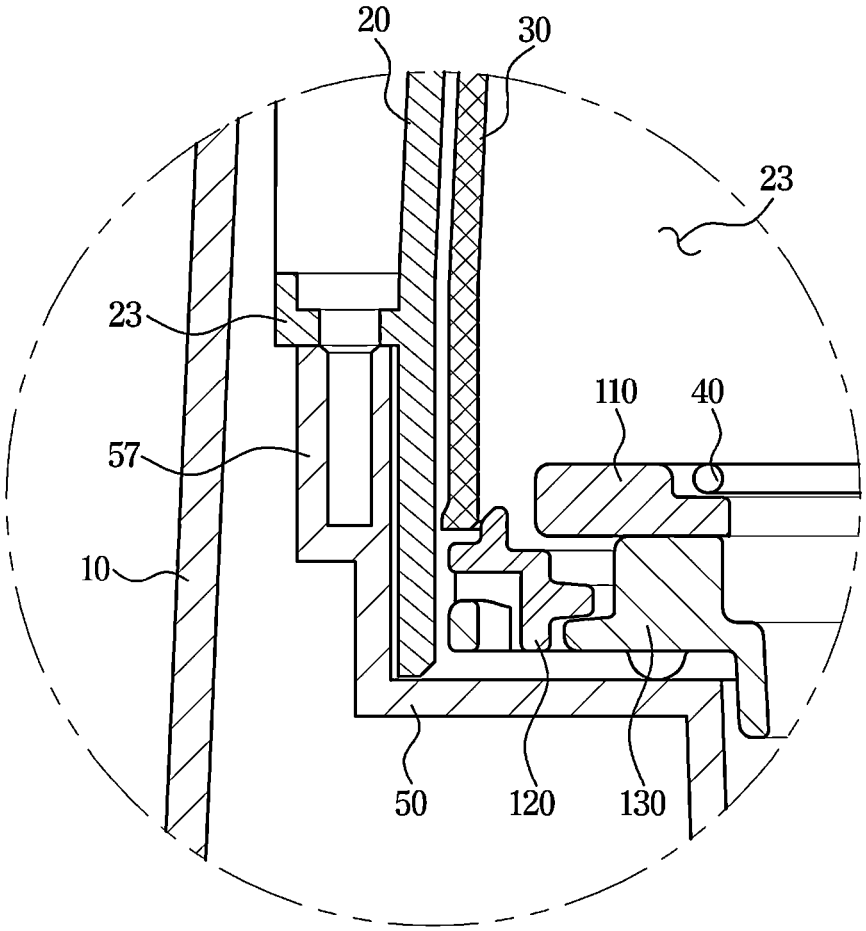
FIG. 12 is an enlarged view illustrating of part D of FIG. 11.

FIG. 11 is a cross-sectional view illustrating the dishwasher according to an embodiment of the disclosure. FIG. 12 is an enlarged view of part D of FIG. 11.

Referring to FIG. 11, the first water spray nozzle 51 and the first rotation nozzle 51*a* may be provided on the upper portion of the washing chamber 23 to spray water while rotating.

The second water spray nozzle 52 and the second rotation nozzle 52*a* may be provided on the lower portion of the washing chamber 23 to spray water while rotating. While the washing process is performed, the basket 40 may also be provided to be rotated by the driver 90, and thus the washing of the dishes placed on the basket 40 may be performed more effectively in a short time.

Figure 20:
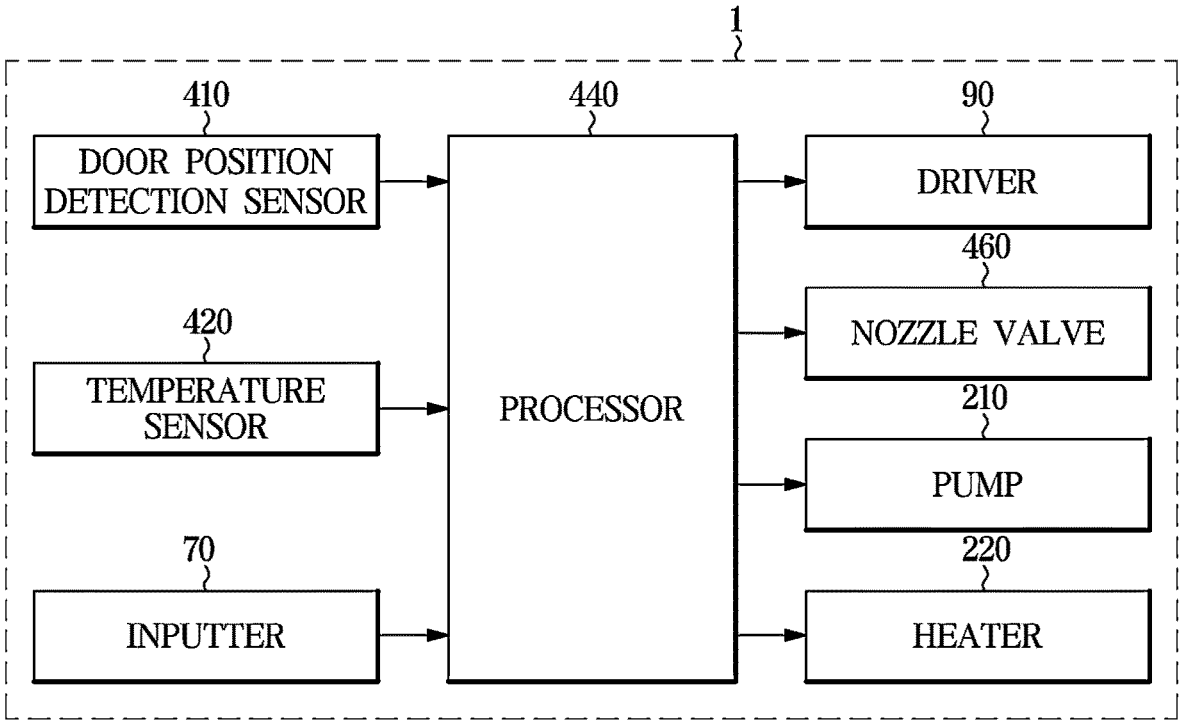
FIG. 20 is a control block diagram illustrating the dishwasher according to one embodiment.

The dishwasher 1 may include a door position detection sensor 410 (see FIG. 20). The door position detection sensor 410 may be provided as a hall sensor 81. However, the type of sensor is not limited thereto.

The tub 20 may include a hall sensor mounting portion 27 on which the hall sensor 81 is mounted. The door 30 may include a magnet mounting portion 33 on which a magnet 82 is mounted. The hall sensor mounting portion 27 and the magnet mounting portion 33 may repeatedly move closer and farther apart as the door 30 rotates inside the tub 20.

The hall sensor 81 may be provided to detect a position of the magnet 82. Accordingly, when the magnet 82 and the hall sensor 81 are aligned on the same line, the hall sensor 81 may detect open or closed states of the door 30. As a result, the washing process is performed only when the door 30 is closed, thereby preventing accidents.

Referring to FIG. 12, an arrangement relationship between the clutch device 100, the door 30, the tub 20, and the sump 50 will be described.

The tub 20 and the sump 50 may be coupled together to form a space in which the clutch device 100 and the door 30 may be accommodated. The tub 20 and the sump 50 may be accommodated within the main body 10 at a certain distance apart.

The door 30 may be coupled to the door rack 120. The door rack 120 may be provided to have a larger radius than the connection rack 130 and the basket rack 110. The door rack 120 may be rotatably provided inside the tub 20 and the sump 50.

The connection rack 130 may be rotatably provided inside the door rack 120. The connection rack 130 may be connected to the basket rack 110. The basket rack 110 may be coupled with the connection rack 130 to cover an upper portion of the connection rack 130. The basket rack 110 may be connected to the basket 40.

Accordingly, the clutch device 100, the basket 40, and the door 30 may be rotatably provided inside the washing chamber 23.

Figure 13:
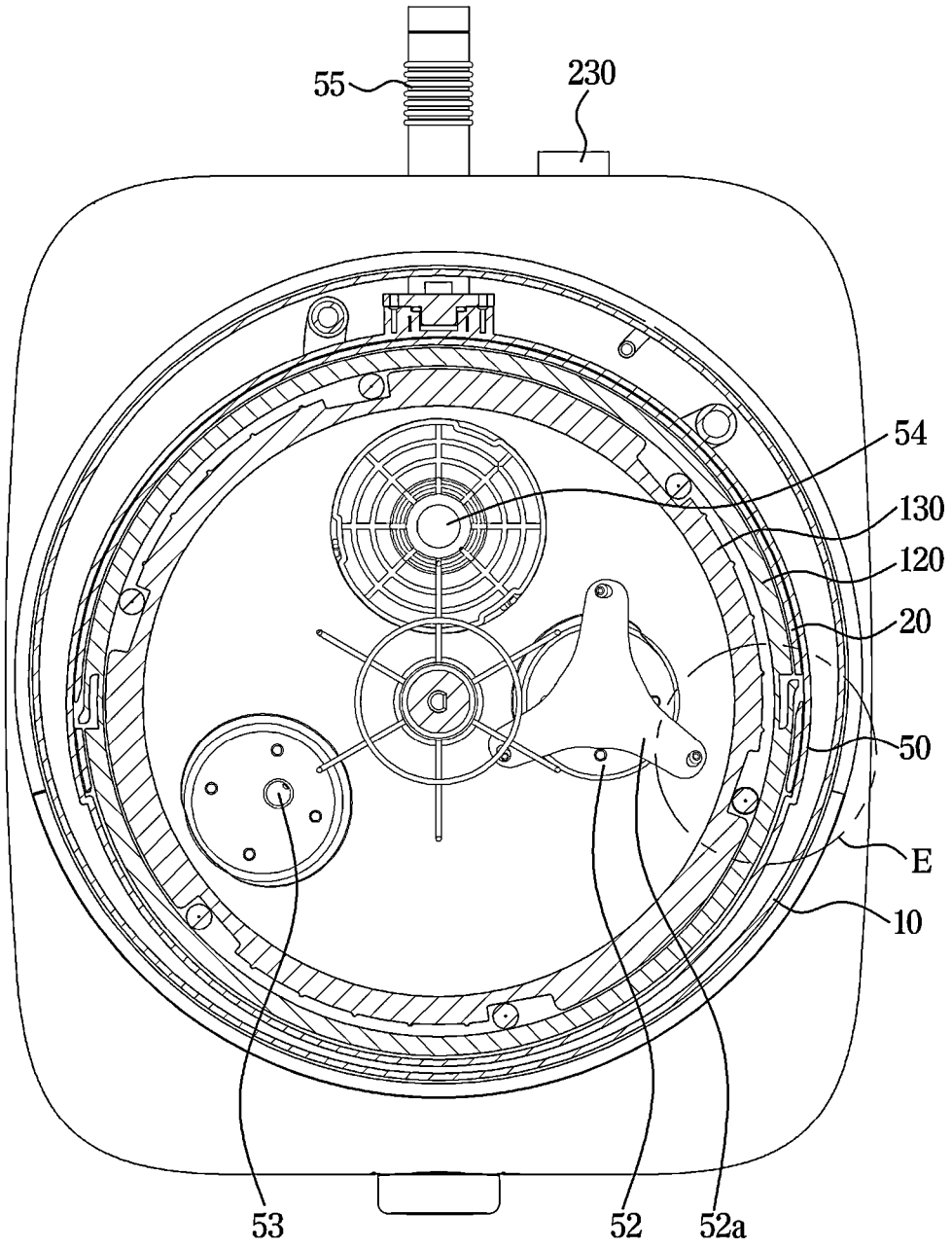
FIG. 13 is a cross-sectional view illustrating a relationship between a connection rack and a door rack of the dishwasher according to an embodiment of the disclosure.
Figure 14:
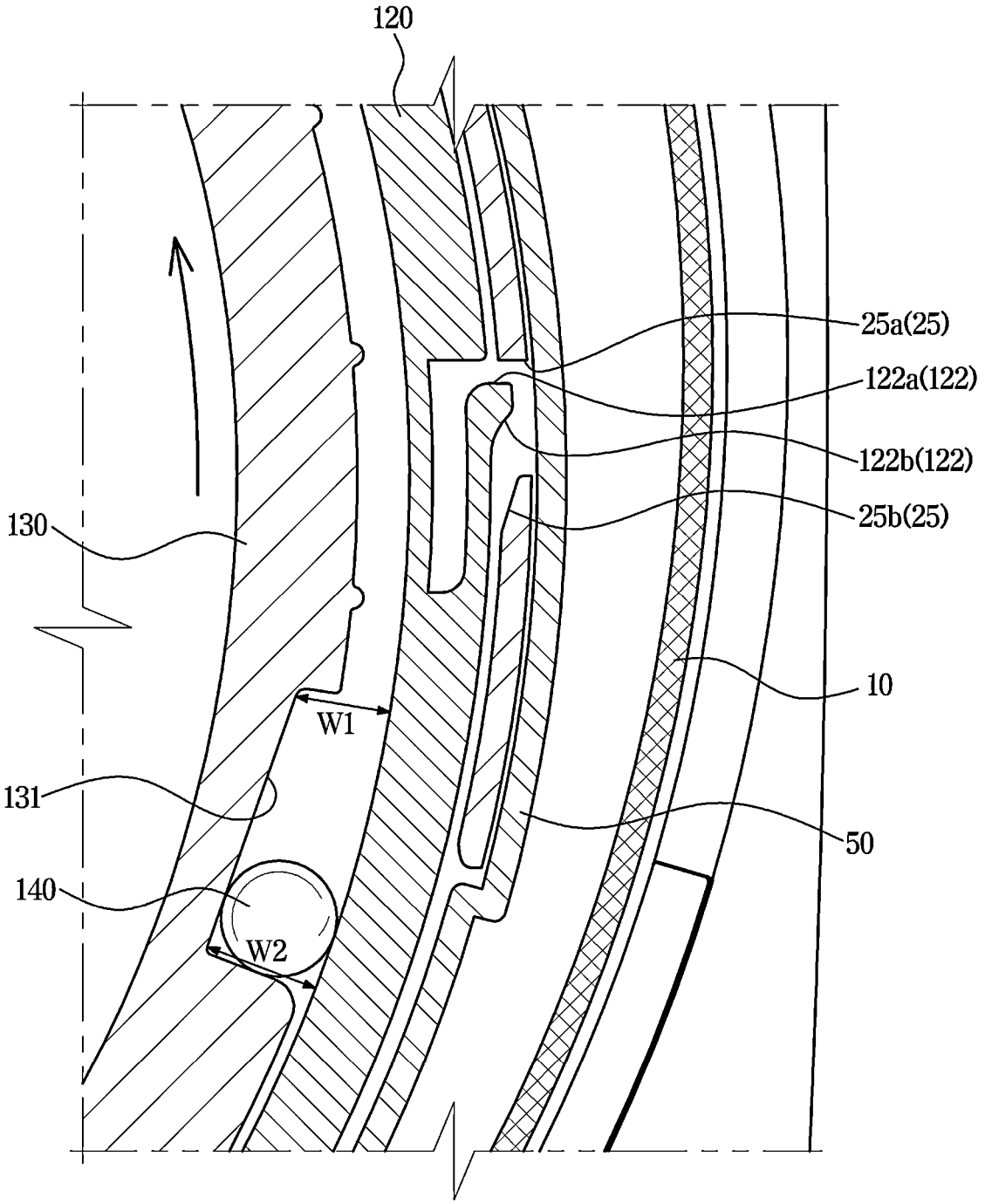
FIG. 14 is an enlarged view illustrating part E of FIG. 13.
Figure 15:
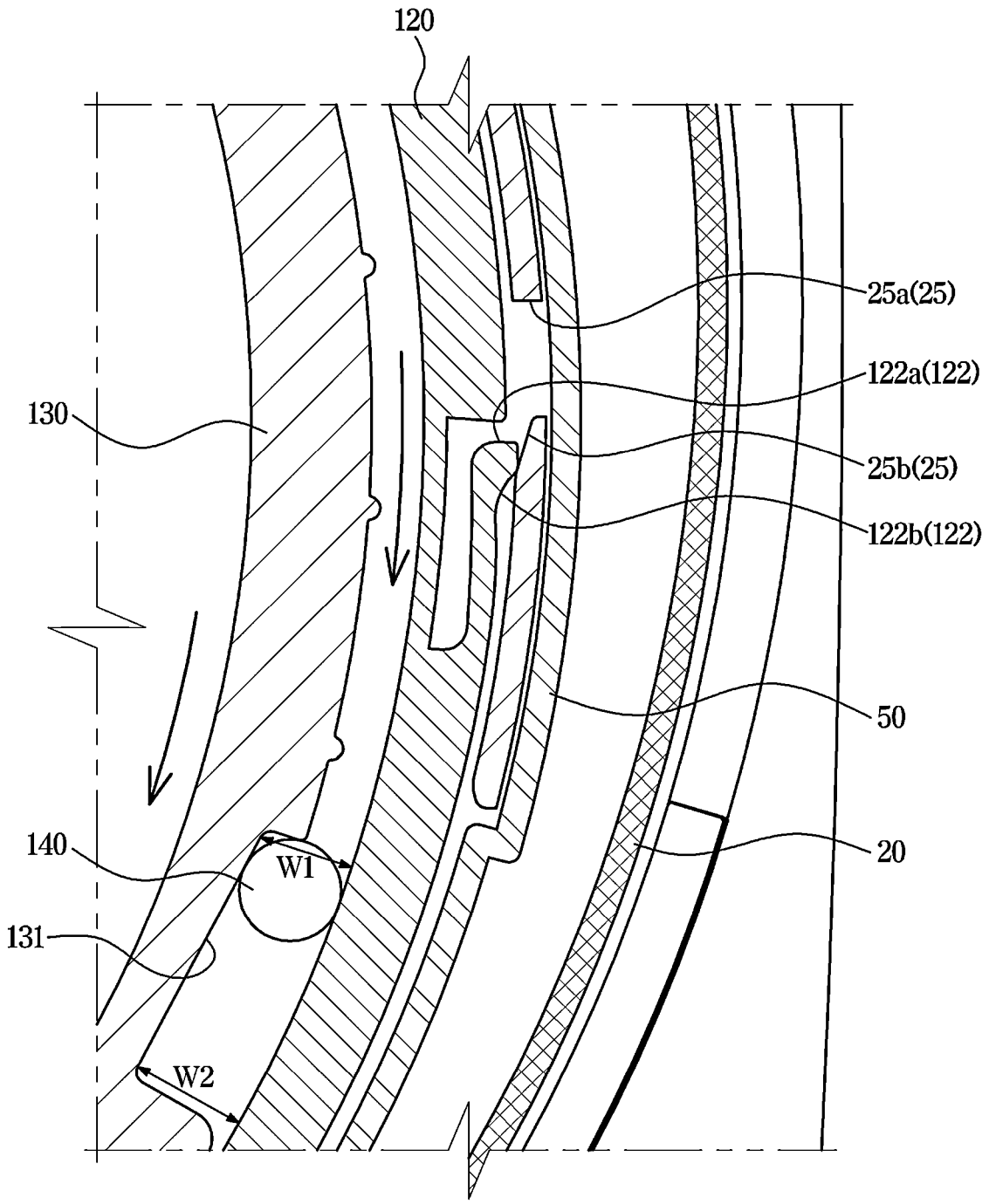
FIG. 15 is a view illustrating the door rack rotating in a first direction based on a first direction rotation of the connection rack of FIG. 14.

FIG. 13 is a cross-sectional view illustrating a relationship between the connection rack and the door rack of the dishwasher according to an embodiment of the disclosure. FIG. 14 is an enlarged view of part E of FIG. 13. FIG. 15 is a view illustrating the door rack rotating in the first direction based on the first direction rotation of the connection rack of FIG. 14.

As shown in FIG. 13, the connection rack 130 may be rotatably provided inside the door rack 120. The door rack 120 may be rotatably provided inside the tub 20.

In addition, at a rear side of the main body 10, a water supplier 230 through which water is supplied from an external water supply source and the drain pipe 55 through which washing water drained from the drain nozzle 54 is discharged may be provided.

Hereinafter, a power transmission relationship between the connection rack 130 and the door rack 120 and a relationship between the interference protrusion 122 and the cutout portion 25 will be explained with reference to FIGS. 14 and 15.

As shown in FIG. 14, the clutch portion 131 of the connection rack 130 may include a portion having a separation distance equal to a first width w1 and a portion having a separation distance equal to a second width w2. More specifically, the clutch portion 131 may be provided to allow a separation distance between the door rack 120 and the clutch portion 131 to gradually increase along the first direction (i.e., clockwise direction). In other words, the second width w2 may be provided to be greater than the first width w1.

In response to the connection rack 130 rotating in the second direction (i.e., counterclockwise direction), the friction bearing 140 may be supported by the portion having the separation distance equal to the second width w2 in the clutch portion 131 of the connection rack 130.

At this time, the friction bearing 140 may be supported on a wide side (i.e., w2) of the clutch portion 131. Accordingly, the friction bearing 140 may not have sufficient friction with the door rack 120 and consequently may not transmit the rotational force of the connection rack 130 to the door rack 120. Accordingly, since the rotational force of the connection rack 130 in the second direction is not allowed to be transmitted to the door rack 120, the door rack 120 is unable to rotate in the second direction.

However, when the rotational force of the connection rack 130 is transmitted to the door rack 120, for example, due to incorrect insertion of the friction bearing 140 or slippage of the clutch device 100, there is a risk that the door rack 120 rotates in the second direction.

To prevent such a risk, the interference protrusion 122 may be formed to protrude outwardly from the door rack 120.

The interference protrusion 122 may include a rack interference portion 122*a* and a rack slide portion 122*b*. More specifically, the rack interference portion 122*a* may be formed on an upper side of the interference protrusion 122 in the second direction, and the rack slide portion 122*b* may be formed on a lower side thereof. The rack interference portion 122*a* may have a cross-section substantially parallel to the radial direction of the door rack 120. The rack slide portion 122*b* may have a cross-section inclined with respect to the radial direction of the door rack 120.

The interfering protrusion 122 may be accommodated in the cutout portion 25 of the tub 20.

The cutout portion 25 of the tub 20 may include the tub interference portion 25*a* and the tub slide portion 25*b*. The tub interference portion 25*a* may have a cross-section corresponding to the rack interference portion 122*a*. In other words, the tub interference portion 25*a* may have a cross-section parallel to the radial direction of the door rack 120.

The tub slide portion 25*b* may have a cross-section corresponding to the rack slide portion 122*b*. In other words, the tub slide portion 25*b* may have a cross-section inclined with respect to the radial direction of the door rack 120.

Accordingly, if the rotational force in the second direction is transmitted to the door rack 120 due to a malfunction of the clutch device 100 in a state in which the interference protrusion 122 is accommodated within the cutout portion 25 of the tub 20, the interference protrusion 122 and the cutout portion 25 may be interfered with, thereby preventing the rotation of the door 30 in the second direction.

More specifically, the rack interference portion 122*a* of the interference protrusion 122 and the tub interference portion 25*a* of the tub 20 interfere with each other to prevent the rotation of the door rack 120 in the second direction, thereby preventing the door 30 coupled to the door rack 120 from rotating in the second direction.

The basket 40 may increase washing performance of the dishes by rotating in the second direction when the washing process is performed, but when the rotational force in the second direction is transmitted to the door 30 during the washing process, the door 30 may open during washing. Accordingly, the interference protrusion 122 may prevent the rotation of the door 30 in the second direction, thereby preventing malfunction of the dishwasher 1.

As shown in FIG. 15, when the connection rack 130 rotates in the first direction (i.e., clockwise direction), the friction bearing 140 may be supported on the portion of the clutch portion 131 having the first width w1. At this time, since the first width w1 corresponds to a narrow width portion of the clutch portion 131, sufficient friction force may be generated between the friction bearing 140 and the door rack 120. As a result, based on the rotation of the connection rack 130 in the first direction, the door rack 120 may also rotate together in the first direction.

In this case, the interference protrusion 122 accommodated in the cutout portion 25 of the tub 20 may also slide and move the cutout portion 25 of the tub 20. More specifically, since the rack slide portion 122*b* of the interference protrusion 122 and the tub slide portion 25*b* of the tub 20 are in contact with each other and are provided to have the same inclined surface, the interference protrusion 122 may be elastically moved inwardly of the cutout portion 25 of the tub 20. As a result, the rotation of the door rack 120 in the first direction may be performed smoothly. Accordingly, the door 30 coupled to the door rack 120 may be rotated in the first direction.

As the door 30 rotates in the first direction, the door 30 may perform the opening and closing process to open or close the opening 21 of the tub 20.

Figure 16:
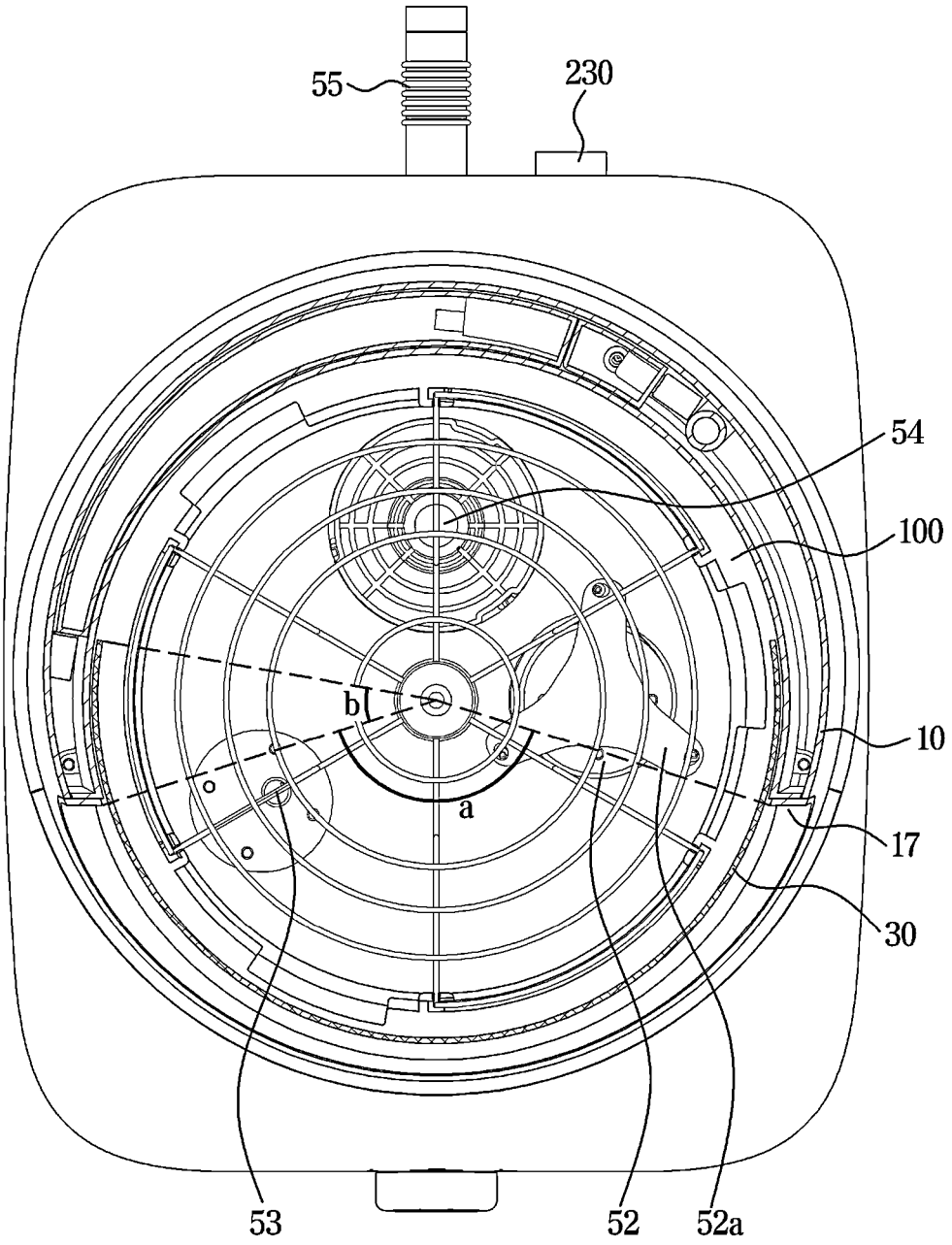
FIG. 16 is a view illustrating an overlap angle with a tub when the door of the dishwasher is closed according to an embodiment of the disclosure.

FIG. 16 is a view illustrating an overlap angle with the tub when the door of the dishwasher is closed according to an embodiment of the disclosure.

Referring to FIG. 16, in response to the door 30 closing the tub 20, the door 30 and the tub 20 may be provided such that some portions overlap.

More specifically, an angle b formed by a line connecting the opening 32 of the door 30 from the center and a line connecting the opening 21 of the tub 20 may preferably be set to within 20°, which may be referred to as an overlap angle b of the door 30 and the tub 20.

If the overlap angle b is too small, water may leak through a gap between the door 30 and the tub 20 during the washing process. In addition, if the overlap angle b is too large, although the door 30 opens the opening 21 of the tub 20, an entrance through which the dishes may be placed is small, causing inconvenience to the user.

Accordingly, the overlap angle b between the door 30 and the tub 20 of the dishwasher 1 according to an embodiment of the disclosure may be set to within 20°, so that water does not leak out during the washing process and at the same time, the dishes may be placed smoothly therein.

In addition, an angle a at which the front surface of the tub 20 is open may be set to within 180°.

Figure 17:
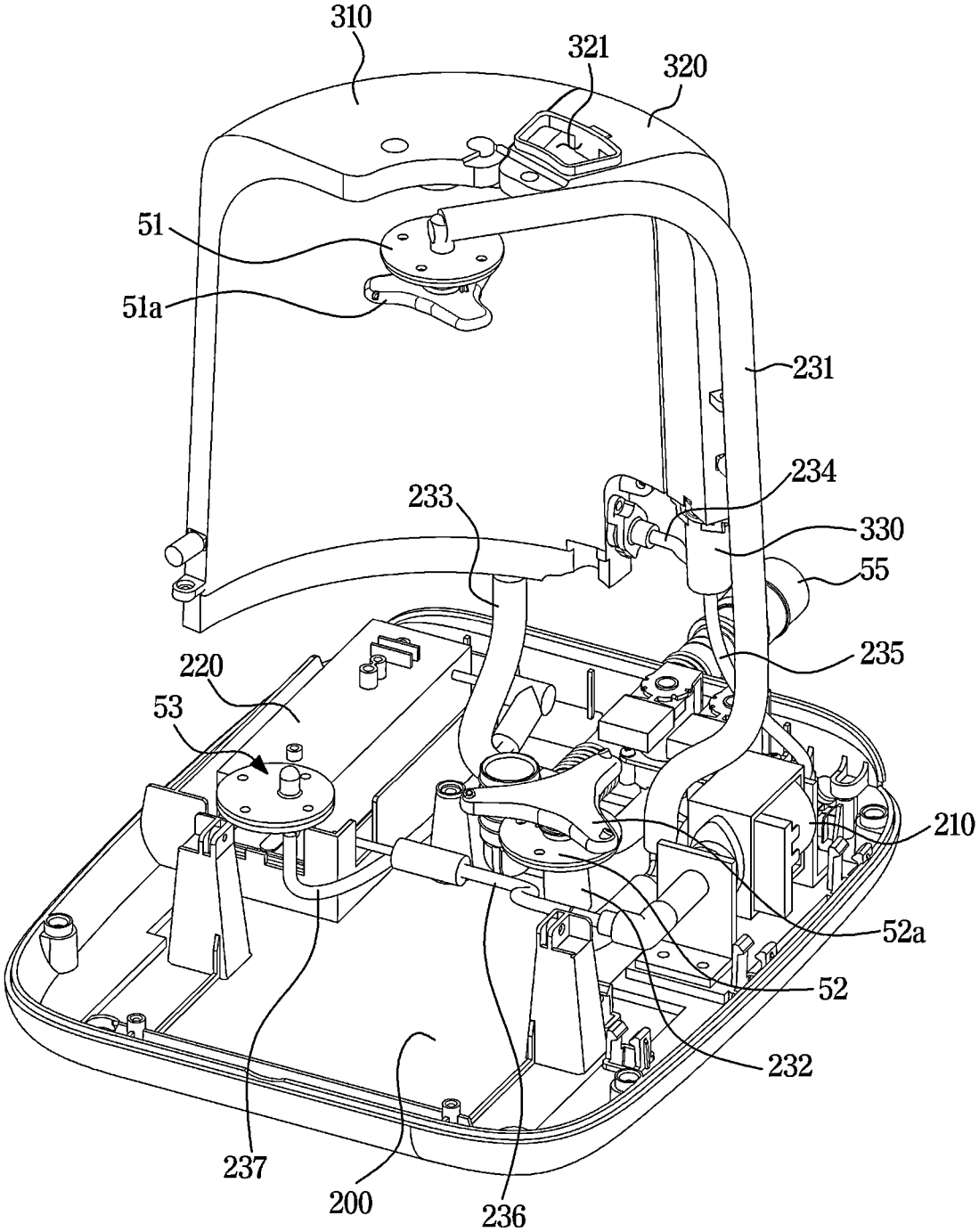
FIG. 17 is a view illustrating a flow path structure of the dishwasher according to an embodiment of the disclosure.
Figure 18:
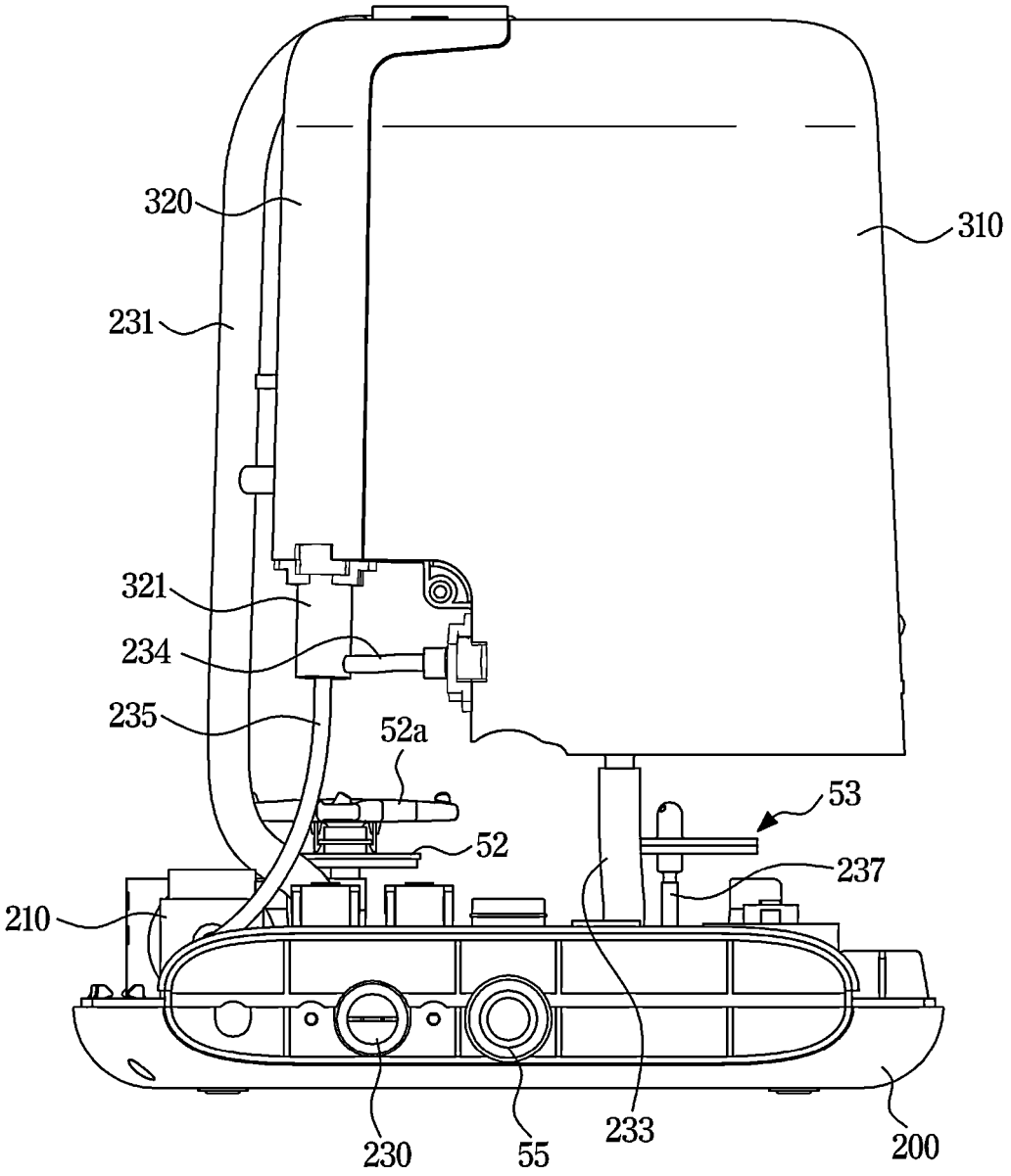
FIG. 18 is a view illustrating the flow path structure of FIG. 16 from the rear.
Figure 19:
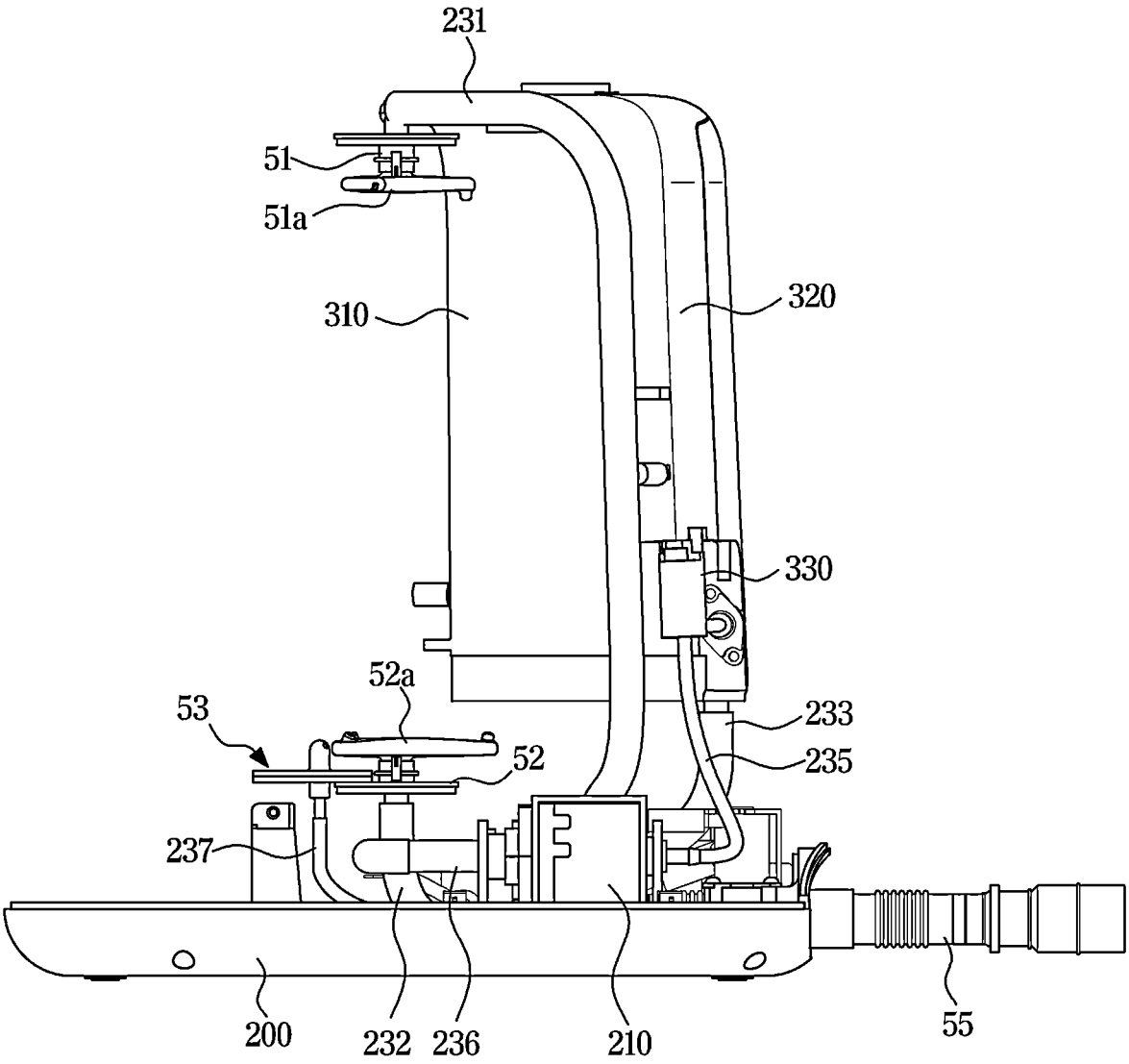
FIG. 19 is a view illustrating the flow path structure of FIG. 16 from the side.

FIG. 17 is a view illustrating a flow path structure of the dishwasher according to an embodiment of the disclosure. FIG. 18 is a view illustrating the flow path structure of FIG. 16 from the rear. FIG. 19 is a view illustrating the flow path structure of FIG. 16 from the side.

Referring to FIGS. 17 to 19, a flow path structure of the dishwasher 1 according to an embodiment of the disclosure will be described.

The dishwasher 1 may include the first water supply pipe 231, a second water supply pipe 232, and the third water supply pipe 233, which are connected to the water supplier 230 that supplies water from an external water supply source.

The first water supply pipe 231 and the second water supply pipe 232 may be provided to branch from the third water supply pipe 233.

The first water supply pipe 231 and the second water supply pipe 232 may be provided as water supply pipes for supplying water. The third water supply pipe 233 is provided to pass through the water tank 310, the detergent tank 320, the pump 210, and the heater 220, which will be described later, and may be provided as a steam supply pipe for finally supplying steam.

The first water supply pipe 231 may be connected to the first water spray nozzle 51 to supply water to the upper portion of the washing chamber 23. The first rotation nozzle 51*a* and the first water spray nozzle 51 may cause water to be rotated and sprayed into the washing chamber 23.

The second water supply pipe 232 may be connected to the second water spray nozzle 52 to supply water to the lower portion of the washing chamber 23. The second rotating nozzle 52*a* and the second water spray nozzle 52 may cause water to be rotated and sprayed into the washing chamber 23. The first water spray nozzle 51 and the second water spray nozzle 52 may each include a nozzle valve (not shown).

The third water supply pipe 233 may be provided to be connected to the water tank 310. Water may be stored in the water tank 310 via the third water supply pipe 233.

The dishwasher 1 may include a water supply pipe 234 connecting the water tank 310 and the mixing tank 330. Water may be supplied from the water tank 310 to the mixing tank 330 through the water supply pipe 234 and mixed with the detergent stored in the mixing tank 330.

The detergent tank 320 and mixing tank 330 may be connected. A detergent inlet 321 may be formed at the upper portion of the detergent tank 320. The detergent introduced through the detergent inlet portion 13 formed at the upper portion of the main body 10 may enter the detergent inlet 321 of the detergent tank 320. In other words, the detergent inlet portion 13 and the detergent inlet 321 may be provided to communicate with each other. The mixing tank 330 connected to the detergent tank 320 may be provided to store a certain amount of detergent at all times.

The dishwasher 1 may include a mixture supply pipe 235 connecting the mixing tank 330 and the pump 210. Water and detergent may be mixed in the mixing tank 330, and the mixed solution may be transferred to the pump 210 through the mixture supply pipe 235.

The dishwasher 1 may include a heater connection pipe 236 connecting the pump 210 and the heater 220. The mixed solution may be transferred from the pump 210 through the heater connection pipe 236 to the heater 220 and be heated in the heater 220.

The dishwasher 1 may include a nozzle connection pipe 237 connecting the heater 220 and the steam nozzle 53. The mixed solution heated in the heater 220 may be supplied to the steam nozzle 53 through the nozzle connection pipe 237, and steam may be injected from the steam nozzle 53.

As such, the structure of the dishwasher 1 has been described in detail. Hereinafter, an operation by which the dishwasher 1 performs the washing process will be described in detail.

FIG. 20 is a control block diagram illustrating the dishwasher according to an embodiment of the disclosure.

Referring to FIG. 20, the dishwasher 1 according to one embodiment of the disclosure may include the door position detection sensor 410 for detecting a position of the door 30, a temperature sensor 420 for detecting the temperature of the heater 220, the inputter 70 for receiving the user input, a processor 440 for controlling the washing process based on the user input, the driver 90 for transmitting rotational force to the door 30 and the basket 40, nozzle valves 460 for opening and closing the spray nozzles 51 and 52, and the pump 210 for supplying the mixed solution supplied from the mixing tank 330 to the heater 220 to spray steam from the steam nozzle 53, and the heater 220 for generating steam by heating the mixed solution supplied from the pump 210.

However, the configurations of the dishwasher 1 shown in FIG. 20 correspond to an example only, and some of the configurations shown may be omitted or other configurations not shown may be added. For example, the dishwasher 1 may include a memory for storing various information required for control and, depending on an embodiment, may further include a blower device for supplying air into the tub 20 after the washing process to dry the dishes.

The door position detection sensor 410 according to an embodiment of the disclosure may detect the position of the door 30, and the processor 440 may identify whether the door 30 opens or closes the opening 21 of the tub 20 based on the output of the door position detection sensor 410.

For example, the door position detection sensor 410 may be provided as the hall sensor 81. The hall sensor 81 may be provided on the door 30 or the main body 10 adjacent to the door 30, and the magnet 82 may be provided on a surface facing the hall sensor 81. For example, as described above, the hall sensor 81 may be provided in the hall sensor mounting portion 27 of the tub 20, and the magnet 82 may be provided in the magnet mounting portion 33 of the door 30.

However, the type of door position detection sensor 410 is not limited to the hall sensor 81, and any sensor capable of detecting the position of an object, such as a piezoelectric sensor or an optical sensor, may be used without limitation.

The temperature sensor 420 according to an embodiment of the disclosure may detect the temperature of the heater 220. The processor 440 may identify the temperature of the heater 220 based on the output of the temperature sensor 420, and control the heater 220 until the heater 220 reaches a predetermined temperature during the washing process. At this time, the temperature sensor 420 may correspond to a known type of temperature sensor.

The inputter 70 according to an embodiment of the disclosure may receive the user input. More specifically, the inputter 70 may receive a command to start the washing process from the user. In addition, the inputter 70 may receive information on an operation time of the washing process from the user.

As described above, the inputter 70 may be provided as a knob, but the type of the inputter 70 is not limited to the above example, and is not limited to any input device capable of receiving the user input, such as a button or a touch screen.

The processor 440 according to an embodiment of the disclosure may control each component of the dishwasher 1 to perform the washing process in response to the command to start the operation (e.g., washing process) being input by the user through the inputter 70.

More specifically, the processor 440 may control the driver 90 to transmit the rotational force in the first direction to the door 30 in response to the command to start the operation being input through the inputter 70.

At this time, the processor 440 may control the driver 90 based on the output of the door position detection sensor 410 until the door 30 reaches a position where the opening 21 of the tub 20 is closed.

The processor 440 may identify whether the door 30 closes the opening 21 of the tub 20 based on the output of the door position detection sensor 410, and in response to the door 30 closing the opening 21 of the tub 20, control the nozzle valves 460 and the pump 210 to perform the washing process which alternates between a water spraying cycle and a steam spraying cycle.

The processor 440 may control the driver 90 to transmit the rotational force in the second direction to the basket 40 during the washing process. In other words, by rotating the basket 40 where the dishes are placed during the water spraying cycle, in which water is sprayed onto the dishes through water spray nozzles (the first water spray nozzle 51 and the second water spray nozzle 52) and the steam spraying cycle, in which steam is sprayed onto the dishes through the steam nozzle 53, the dishwasher 1 may increase the washing efficiency of the dishes by ensuring that the water and steam are uniformly distributed on all sides of the dishes.

When starting the washing process, the processor 440 may control the nozzle valves 460 to preferentially spray water onto the dishes. More specifically, the processor 440 may control the nozzle valves 460 to open the water spray nozzles 51 and 52 for a first time (e.g., 10 seconds) when the door 30 closes the tub 20. The processor 440 may control the nozzle valves 460 and the pump 210 to alternate between the water spraying cycle and the steam spraying cycle after the first time has elapsed.

At this time, the processor 440 may control the heater 220 to allow the temperature of the heater 220 to reach the set temperature before the first time elapses. The set temperature of the heater 220 may be a temperature (e.g., a maximum of 150° C. at which the mixed solution may be converted into steam by passing through the heater 220. Accordingly, at the start of the washing process, the dishwasher 1 may perform the water spraying cycle that preferentially sprays water to ensure a preheating time for the heater 220 for steam generation and at the same time to perform a preliminary washing of the dishes.

The processor 440 may control the nozzle valves 460 to close the water spray nozzles 51 and 52 after the first time has elapsed, and control, based on the closing of the water spray nozzles 51 and 52, the pump 210 to perform the steam spraying cycle for a second time (e.g., 20 seconds), thereby initiating an alternating operation of the water spraying cycle and the steam spraying cycle. At this time, the processor 440 may control the nozzle valves 460 to perform the water spraying cycle for a third time (e.g., 10 seconds) in response to the steam spraying cycle terminating after the second time has elapsed.

The processor 440 may determine the number of alternating times of the water spraying cycle and the steam spraying cycle based on operation time information received from the inputter 70. For example, if the second time during which the steam spraying cycle is performed is 20 seconds and the third time during which the water spraying cycle is performed is 10 seconds, the user may input the operation time information of the washing process in units of 30 seconds through the inputter 70 and the processor 140 may determine the number of alternating times of the water spraying cycle and the steam spraying cycle based on the operation time information input by the inputter 70. For example, if the user sets an operation time that is 60 seconds longer than the operation time corresponding to one alternating number through the inputter 70, the processor 440 may control the nozzle valves 460 and the pump 210 to perform a total of three alternating times.

When controlling the nozzle valves 460 and the pump 210 to perform the washing process, the processor 440 may end the washing process after the water spraying cycle is performed. In other words, the processor 440 may control the nozzle valves 460 and the pump 210 to allow the washing process to end with a water spraying cycle. As a result, the dishwasher 1 may rinse off any detergent that may remain on the dishes, thereby ending the washing process without detergent.

The processor 440 may control the driver 90 to transmit the rotational force in the first direction to the door 30 when the washing process is complete. At this time, the processor 440 may control the driver 90 until the door 30 opens the tub 20 to allow the user to take out the dishes placed in the tub 20.

The driver 90 according to an embodiment of the disclosure may include the motor 91 capable of transmitting rotational force to the door 30 and the basket 40. When rotating in the first direction, the driver 90 may transmit the rotational force in the first direction to the door 30 and the basket 40, and when rotating in the second direction, the driver 90 may transmit the rotational force in the second direction to the basket 40.

The nozzle valve 460 according to an embodiment of the disclosure each may open and close the water spray nozzles 51 and 52, and in response to the nozzle valves 460 opening the water spray nozzles 51 and 52, water may be sprayed from the water spray nozzles 51 and 52 onto the dishes based on water pressure.

The pump 210 according to an embodiment of the disclosure may supply the mixed solution supplied from the mixing tank 330 to the heater 220 to allow steam to be sprayed from the steam nozzle 53. In other words, the pump 210 may draw in the mixed solution from the mixing tank 330 when operating and discharge the drawn mixed solution toward the heater 220 and the steam nozzle 53 side, and thus the drawn mixed solution may pass through the heater 220 and be sprayed from the steam nozzle 53. At this time, the mixed solution may be heated by the heater 220 and converted into steam, which may then be sprayed onto the dishes through the steam nozzle 53.

The heater 220 according to an embodiment of the disclosure may be provided on the flow path between the pump 210 and the steam valve and may transfer heat to the mixed solution supplied from the pump 210. The mixed solution that has passed through the heater 220 may be heated and converted into steam, which may be sprayed onto the dishes through the steam nozzle 53.

In the above, each configuration of the dishwasher 1 has been described in detail. In the following, a performance of the washing process using each component of the dishwasher 1 will be described in more detail.

FIG. 21 is a view illustrating a case in which the dishwasher 1 according to an embodiment of the disclosure controls the driver 90 to transmit rotational force to the door 30 and the basket 40.

Referring to FIG. 21, the dishwasher 1 according to an embodiment of the disclosure may control the driver 90 to transmit the rotational force to the door 30 and the basket 40.

More specifically, the dishwasher 1 may control the driver 90 to rotate in the first direction to generate the rotational force in the first direction. In this case, both the door 30 and the basket 40 may rotate in the first direction.

Upon input of the operation start command, the dishwasher 1 may rotate the driver 90 in the first direction to allow the door 30 to rotate in the first direction to close the opening 21 of the tub 20. In addition, upon completion of the washing process, the dishwasher 1 may rotate the driver 90 in the first direction to allow the door 30 to rotate in the first direction to open the opening 21 of the tub 20.

Furthermore, the dishwasher 1 may control the driver 90 to rotate in the second direction to generate the rotational force in the second direction. In this case, the basket 40 may only rotate in the second direction. In other words, as described above, when the driver 90 rotates in the second direction, the rotational force of the connection rack 130 may not be transmitted to the door rack 120, thereby preventing the door 30 from rotating in the second direction.

More specifically, the dishwasher 1 may rotate the driver 90 in the second direction to allow the basket 40 to be rotated only when performing the washing process, prevent the door 30 from rotating to open the opening 21 of the tub 20 during the washing process, and allow the sprayed water and steam to reach all faces of the dishes placed in the basket 40, thereby increasing the washing efficiency.

Figure 22:
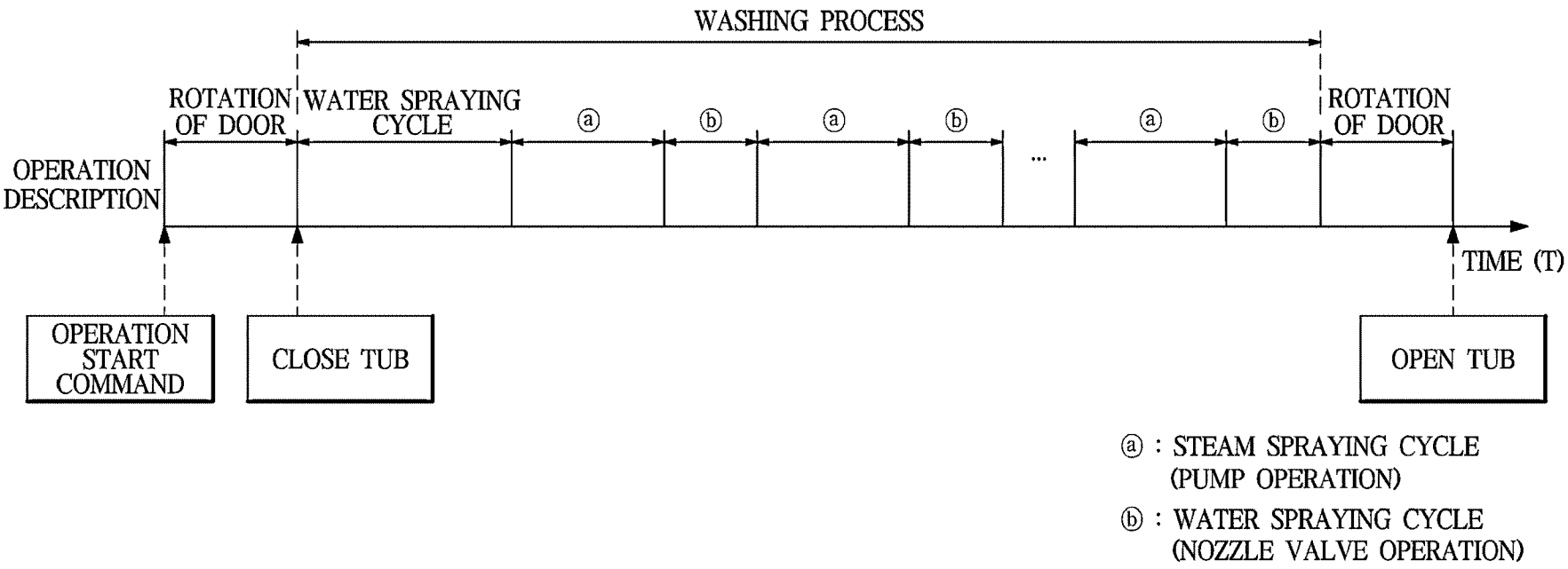
FIG. 22 is a view illustrating a case in which the dishwasher performs a washing process according to an embodiment of the disclosure.
Figure 23:
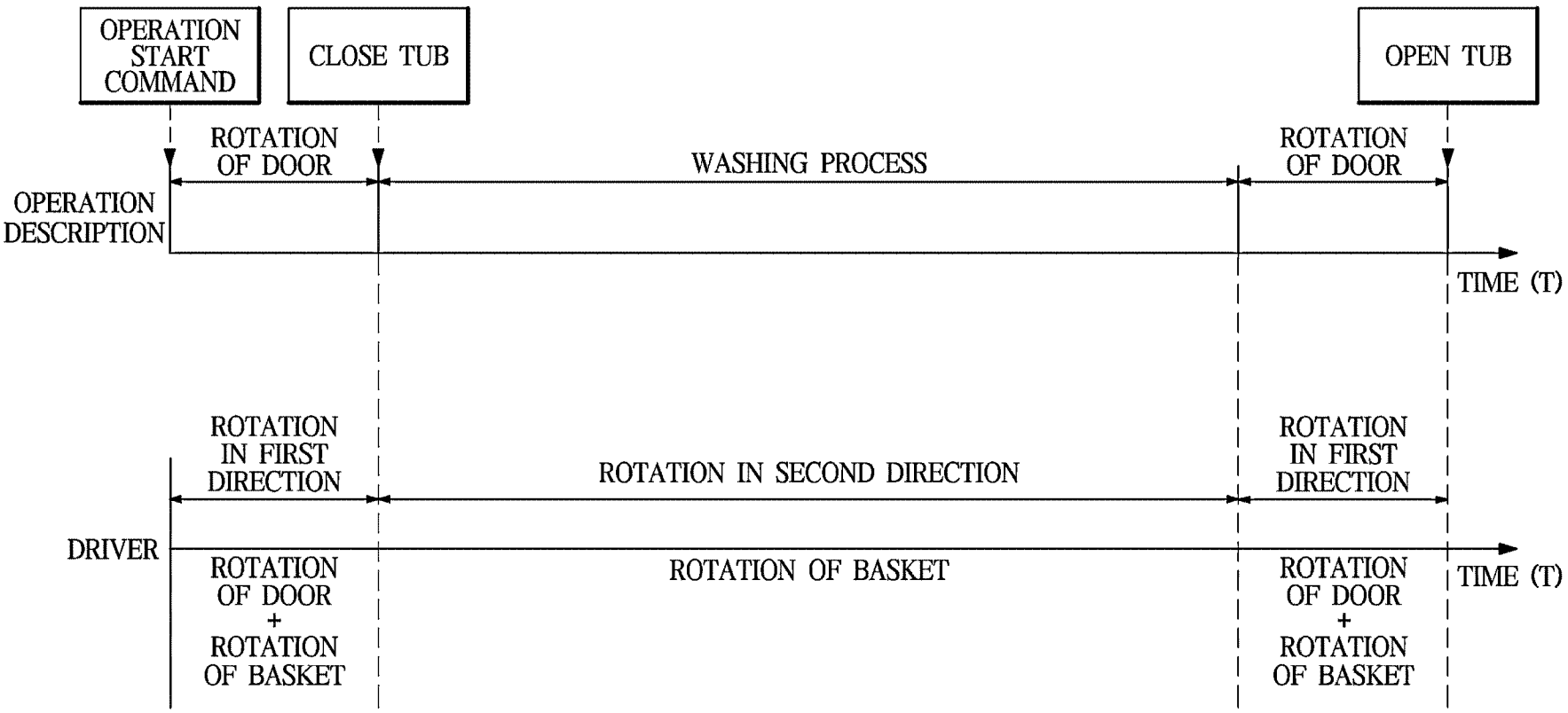
FIG. 23 is a view illustrating a case in which the dishwasher controls the driver during the washing process according to an embodiment of the disclosure.
Figure 24:
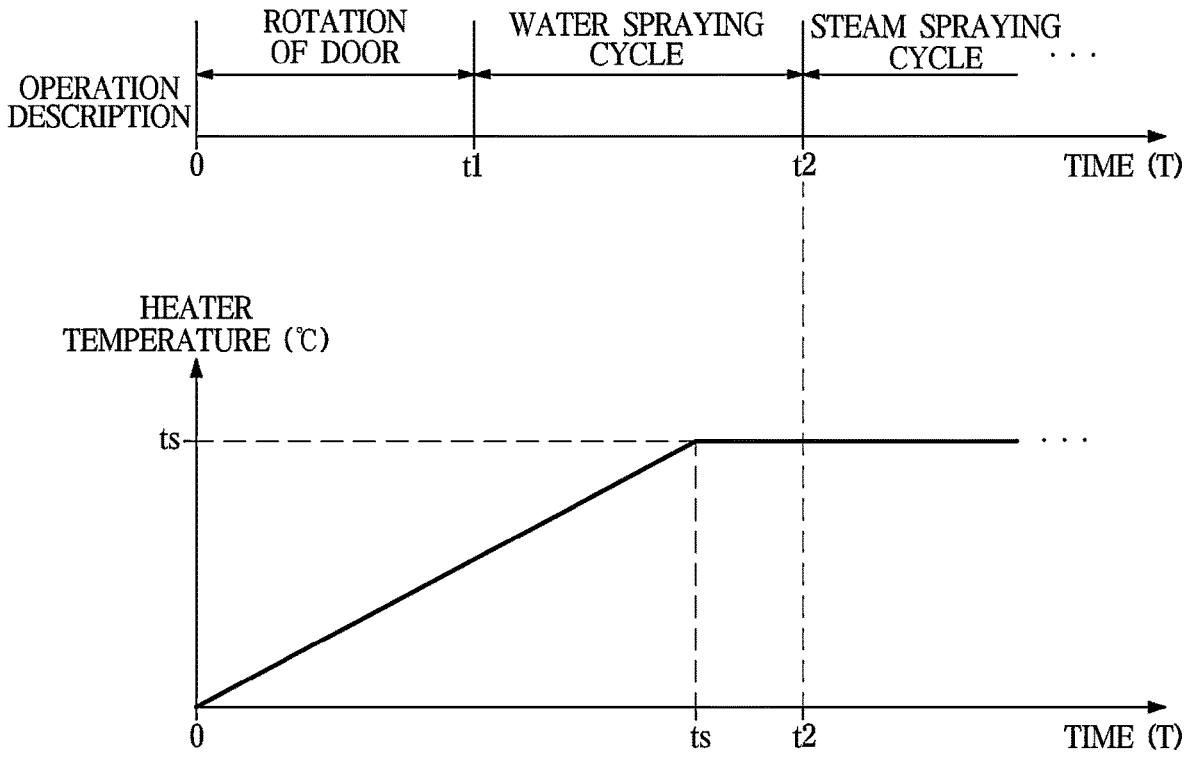
FIG. 24 is a view for explaining a case in which the dishwasher controls a heater to reach a set temperature according to an embodiment of the disclosure.

FIG. 22 is a view illustrating a case in which the dishwasher according to an embodiment of the disclosure performs the washing process, FIG. 23 is a view illustrating a case in which the dishwasher according to an embodiment of the disclosure controls the driver during the washing process, and FIG. 24 is a view illustrating a case in which the dishwasher according to an embodiment of the disclosure controls the heater to reach the set temperature.

Referring to FIGS. 22 to 24, the dishwasher 1 according to an embodiment of the disclosure may control each configuration to alternately perform the steam spraying cycle and the water spraying cycle when performing the washing process, thereby increasing dishwashing efficiency.

More specifically, upon input of the operation start command by the inputter 70, the dishwasher 1 may control the driver 90 to transmit the rotational force in the first direction to the door 30.

At this time, the dishwasher 1 may control the driver 90 based on the output of the door position detection sensor 410 until the door 30 reaches the position where the opening 21 of the tub 20 is closed.

The dishwasher 1 may identify whether the door 30 closes the opening 21 of the tub 20 based on the output of the door position detection sensor 410, and upon identification on whether the door 30 closes the opening 21 of the tub 20, control the nozzle valves 460 and the pump 210 to initiate the washing process that alternates between the water spraying cycle and the steam spraying cycle.

As shown in FIG. 23, the dishwasher 1 may control the driver 90 to transmit the rotational force in the second direction to the basket 40 during the washing process. In other words, by rotating the basket 40 where the dishes are placed during the water spraying cycle, in which water is sprayed onto the dishes through water spray nozzles (the first water spray nozzle 51 and the second water spray nozzle 52) and the steam spraying cycle, in which steam is sprayed onto the dishes through the steam nozzle 53, the dishwasher 1 may increase the washing efficiency of the dishes by ensuring that the water and steam are uniformly distributed on all faces of the dishes.

As shown in FIG. 22, when starting the washing process, the dishwasher 1 may control the nozzle valves 460 to preferentially spray water onto the dishes. More specifically, the dishwasher 1 may control the nozzle valves 460 to open the water spray nozzles 51 and 52 for the first time (e.g., 10 seconds) when the door 30 closes the tub 20. When the nozzle valves 460 are in an open state, water may be sprayed into the tub 20 from the water spray nozzles 51 and 52 based on the pressure of water supplied from the water supplier 230. The dishwasher 1 may control the nozzle valves 460 and the pump 210 to alternate between the water spraying cycle and the steam spraying cycle after the first time has elapsed.

At this time, as shown in FIG. 24, the dishwasher 1 may control the heater 220 to allow the temperature of the heater 220 to reach the set temperature (Ts) before the first time (t1 to t2) elapses (ts). The set temperature (Ts) of the heater 220 may be a temperature (e.g., the maximum of 150° C.) at which the mixed solution may be converted into steam by passing through the heater 220. At this time, the heater 220 may maintain the set temperature (Ts) while the washing process is performed. Accordingly, at the start of the washing process, the dishwasher 1 may perform the water spraying cycle that preferentially sprays water to ensure the preheating time for the heater 220 for steam generation and at the same time to perform the preliminary washing of the dishes.

Referring to FIG. 22 again, the dishwasher 1 according to an embodiment of the disclosure may control the nozzle valves 460 and the pump 210 to alternately perform the steam spraying cycle ⓐ and the water spraying cycle ⓑ after the first time has elapsed. For example, the dishwasher 1 may control the nozzle valves 460 to close the water spray nozzles 51 and 52 after the first time has elapsed, and control, based on the closing of the water spray nozzles 51 and 52, the pump 210 to perform the steam spraying cycle for the second time (e.g., 20 seconds), thereby initiating the alternating operation of the steam spraying cycle ⓐ and the water spraying cycle ⓑ. At this time, the dishwasher 1 may control the nozzle valves 460 to perform the water spraying cycle for the third time (e.g., 10 seconds) in response to the steam spraying cycle terminating after the second time lapse.

In other words, the dishwasher 1 may control the nozzle valves 460 and the pump 210 to alternately perform the steam spraying cycle ⓐ for the second time and the water spraying cycle ⓑ for the third time after the water injection at the first time.

During the steam spraying cycle ⓐ, the pump 210 may operate. The pump 210 may supply the mixed solution supplied from the mixing tank 330 to the heater 220 to allow steam to be sprayed from the steam nozzle 53. In other words, the pump 210 may suction the mixed solution from the mixing tank 330 when operating and discharge the suctioned mixed solution to the heater 220 and the steam nozzle 53. As a result, the suctioned mixed solution may pass through the heater 220 to be sprayed from the steam nozzle 53. At this time, the mixed solution may be heated by the heater 220 and converted into steam, and thus the steam may be sprayed onto the dishes through the steam nozzle 53.

In addition, during the water spraying cycle ⓑ, the nozzle valve 460 may be open. In this case, water may be sprayed into the tub 20 from the water spray nozzles 51 and 52 based on the pressure of the water supplied from the water supplier 230.

The dishwasher 1 may determine the number of alternating times of the steam spraying cycle ⓐ and the water spraying cycle ⓑ based on the operation time information received from the inputter 70. For example, if the second time for which the steam spraying cycle ⓐ is performed is 20 seconds and the third time for which the water spray stroke ⓑ is performed is 10 seconds, the user may input the operation time information of the washing process in units of 30 seconds through the inputter 70 and the dishwasher 1 may determine the number of alternating times of the steam spraying cycle ⓐ and the water spraying cycle ⓑ based on the operation time information input by the inputter 70. For example, if the user sets the operation time that is 60 seconds longer than the operation time corresponding to one alternating number through the inputter 70, the dishwasher 1 may control the nozzle valves 460 and the pump 210 to perform a total of three alternating times.

As shown in FIG. 22, when controlling the nozzle valves 460 and the pump 210 to perform the washing process, the dishwasher 1 may end the washing process after the water spraying cycle ⓑ is performed. In other words, the dishwasher 1 may control the nozzle valves 460 and the pump 210 to allow washing process to end with the water spraying cycle ⓑ. As a result, the dishwasher 1 may rinse off any detergent that may remain on the dishes, thereby ending the washing process without detergent.

The dishwasher 1 may control the driver 90 to transmit the rotational force in the first direction to the door 30 when the washing process is ended. At this time, the dishwasher 1 may control the driver 90 until the door 30 opens the tub 20 to allow the user to take out the dishes placed in the tub 20.

Hereinafter, a method for controlling the dishwasher 1 according to an embodiment of the disclosure will be described. The dishwasher 1 according to the above-described embodiment may be used in the method of controlling the dishwasher 1. Accordingly, the foregoing description with reference to FIGS. 1 to 24 may be equally applicable to the method of controlling the dishwasher 1.

Figure 25:
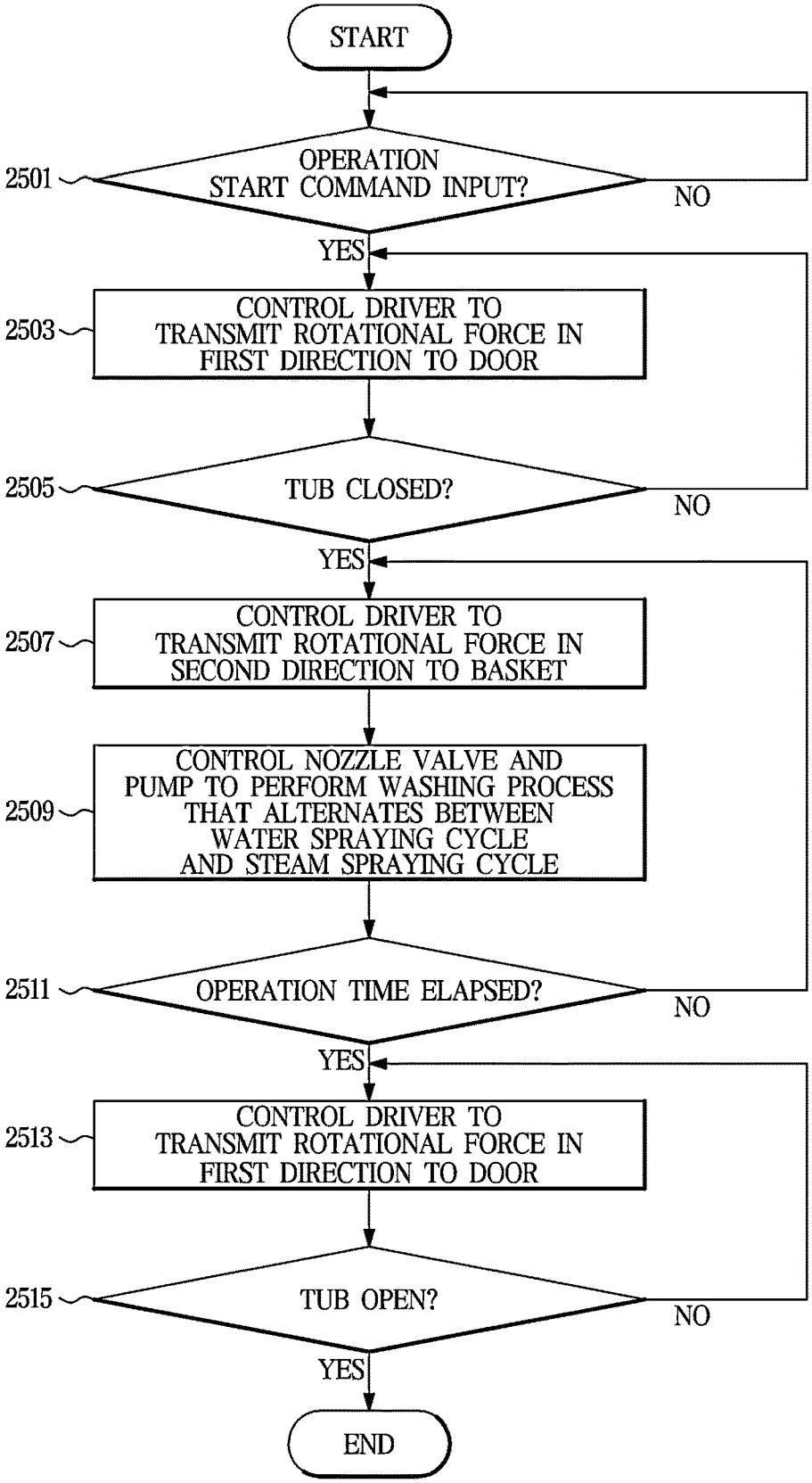
FIG. 25 is a flowchart of performing the washing process in a method of controlling a dishwasher according to an embodiment of the disclosure.

FIG. 25 is a flow chart of performing the washing process in the method of controlling the dishwasher 1 according to an embodiment of the disclosure.

Referring to FIG. 25, in response to the operation start command being input (Yes in 2501), the dishwasher 1 according to an embodiment may control the driver 90 to transmit the rotational force in the first direction to the door 30 (2503).

In response to the tub 20 being closed as the door 30 rotates (Yes in 2505), the dishwasher 1 according to an embodiment may control the driver 90 to transmit the rotational force in the second direction to the basket 40 (2507) and control the nozzle valves 460 and the pump 210 to perform the washing process that alternates between the water spraying cycle ⓑ and the steam spraying cycle ⓐ (2509).

During the steam spraying cycle ⓐ, the pump 210 may operate. The pump 210 may supply the mixed solution supplied from the mixing tank 330 to the heater 220 to allow steam to be sprayed from the steam nozzle 53. In other words, the pump 210 may draw in the mixed solution from the mixing tank 330 when operating and discharge the drawn mixed solution to the heater 220 and the steam nozzle 53. As a result, the drawn mixed solution may pass through the heater 220 to be sprayed from the steam nozzle 53. At this time, the mixed solution may be heated by the heater 220 and converted into steam, and thus the steam may be sprayed onto the dishes through the steam nozzle 53.

In addition, during the water spraying stroke ⓑ, the nozzle valves 460 may be open. In this case, water may be sprayed into the tub 20 from the water spray nozzles 51 and 52 based on the pressure of the water supplied from the water supplier 230.

In addition, the dishwasher 1 may control the driver 90 to transmit the rotational force in the second direction to the basket 40 during the washing process. In other words, by rotating the basket 40 where the dishes are placed during the water spraying cycle, in which water is sprayed onto the dishes through water spray nozzles (the first water spray nozzle 51 and the second water spray nozzle 52) and the steam spraying cycle, in which steam is sprayed onto the dishes through the steam nozzle 53, the dishwasher 1 may increase the washing efficiency of the dishes by ensuring that the water and steam are uniformly distributed on all faces of the dishes.

In response to the operation time of the washing process having elapsed (Yes in 2511), the dishwasher 1 according to an embodiment of the disclosure may control the driver 90 to transmit the rotational force in the first direction to the door 30 (2513). At this time, the dishwasher 1 may control the driver 90 to transmit the rotational force in the first direction to the door 30 (2513) until the tub 20 is open (Yes in 2515).

Figure 26:
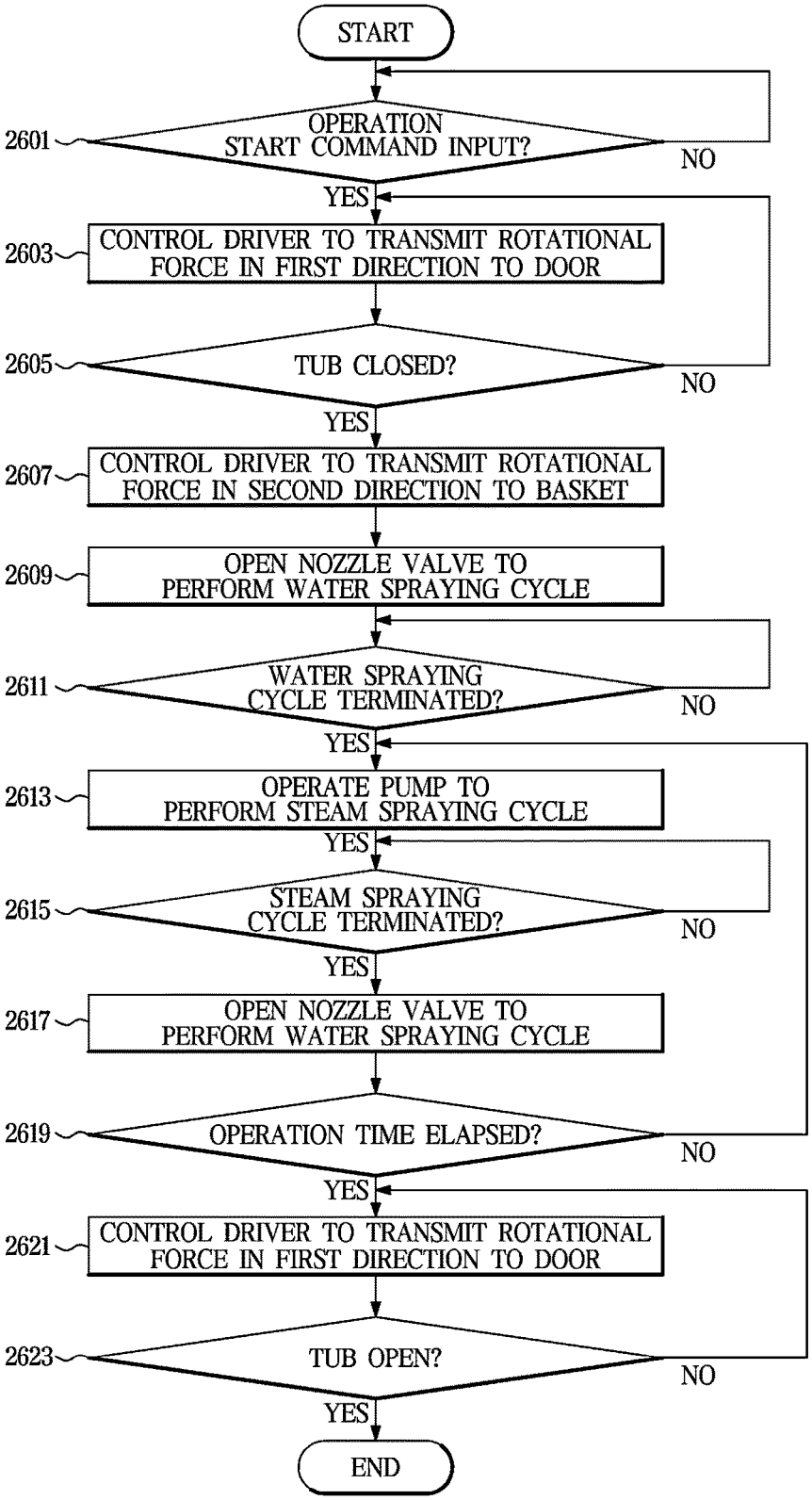
FIG. 26 is a flowchart of performing the washing process in the method of controlling the dishwasher according to an embodiment of the disclosure.

FIG. 26 is a flowchart of performing the washing process in the method of controlling the dishwasher according to an embodiment of the disclosure.

Referring to FIG. 26, in response to the operation start command being input (Yes in 2601), the dishwasher 1 according to an embodiment may control the driver 90 to transmit the rotational force in the first direction to the door 30 (2603).

In response to the tub 20 being closed as the door 30 rotates (Yes in 2605), the dishwasher 1 according to an embodiment may control the driver 90 to transmit the rotational force in the second direction to the basket 40 (2607) and open the nozzle valves 460 to perform the water spraying cycle (2609).

At the start of the washing process, the dishwasher 1 may control the nozzle valves 460 to spray water preferentially onto the dishes. More specifically, the dishwasher 1 may control the nozzle valves 460 to open the water spray nozzles 51 and 52 for the first time (e.g., 10 seconds) in response to the door 30 closing the tub 20. When the nozzle valves 460 are in an open state, water may be sprayed into the tub 20 from the water spray nozzles 51 and 52 based on the pressure of water supplied from the water supplier 230. The dishwasher 1 may control the nozzle valves 460 and the pump 210 to alternate between the water spraying cycle and the steam spraying cycle after the first time has elapsed.

At this time, the dishwasher 1 may control the heater 220 to allow the temperature of the heater 220 to reach the set temperature (Ts) before the first time (t1 to t2) elapses (ts). The set temperature (Ts) of the heater 220 maybe a temperature (e.g., the maximum of 150° C.) at which the mixed solution may be converted into steam by passing through the heater 220. At this time, the heater 220 may maintain the set temperature (Ts) while the washing process is performed. Accordingly, at the start of the washing process, the dishwasher 1 may perform the water spraying cycle that preferentially sprays water to ensure the preheating time for the heater 220 for steam generation and at the same time to perform the preliminary washing of the dishes.

The dishwasher 1 according to an embodiment may operate the pump 210 to perform the steam spraying cycle (2613) in response to the water spraying cycle being terminated (Yes in 2611), and in response to the steam spraying cycle being terminated (Yes in 2615), open the nozzle valves 460 to perform the water spraying cycle (2617). The dishwasher 1 may alternately perform the steam spraying cycle (2613) and the water spraying cycle (2617) until the operation time of the washing process has elapses (Yes in 2619).

The dishwasher 1 may determine the number of alternating times of the steam spraying cycle ⓐ and the water spraying cycle ⓑ based on the operation time information received from the inputter 70. For example, if the second time for which the steam spraying cycle ⓐ is performed is 20 seconds and the third time for which the water spraying cycle ⓑ is performed is 10 seconds, the user may input the operation time information of the washing process in units of 30 seconds through the inputter 70 and the dishwasher 1 may determine the number of alternating times of the steam spraying cycle ⓐ and the water spraying cycle ⓑ based on the operation time information input by the inputter 70. For example, if the user sets the operation time that is 60 seconds longer than the operation time corresponding to one alternating number through the inputter 70, the dishwasher 1 may control the nozzle valves 460 and the pump 210 to perform a total of three alternating times.

The dishwasher 1 according to an embodiment may control the driver 90 to transmit the rotational force in the first direction to the door 30 (2621) in response to the operation time of the washing process having elapsed (Yes in 2619). At this time, the dishwasher 1 may control the driver 90 to transmit the rotational force in the first direction to the door 30 (2621) until the tub 20 is open (Yes in 2623).

While the disclosure has been particularly described with reference to exemplary embodiments, it should be understood by those of skilled in the art that various changes in form and details may be made without departing from the spirit and scope of the disclosure.

What is claimed is:

1. A dishwasher, comprising:

a main body;

a tub disposed inside the main body, having a washing chamber formed therein, and having an opening at a front side thereof;

a basket configured to be rotatable in a first direction or a second direction inside the tub;

a driver configured to supply power to rotate the basket; and a door configured to be rotatable in the first direction based on a rotation of the basket in the first direction to open or close the opening of the tub.

2. The dishwasher of claim 1, further comprising a clutch device configured to be rotatable within the tub to selectively transmit a rotational force of the basket to the door.

3. The dishwasher of claim 2, wherein the clutch device comprises:

a basket rack coupled to the basket to be rotatable;

a door rack coupled to the door to be rotatable; and a connection rack coupled to the basket rack to be rotatable together with the basket rack, the connecting rack configured to transmit a rotational force to the door rack in response to the rotating of the basket rack in the first direction and not to transmit the rotational force to the door rack in response to the rotating of the basket rack in the second direction.

4. The dishwasher of claim 3, wherein the connection rack comprises a clutch portion recessed from an outer side of the connection rack such that a distance with the door rack gradually increases along the first direction, the clutch portion being provided with a friction bearing transmitting the rotational force to the door rack by friction.

5. The dishwasher of claim 3, further comprising an interference protrusion protruding towards a side of the door rack to be accommodated in a cutout portion of the tub so as to prevent the door from rotating in the second direction.

6. The dishwasher of claim 5, wherein the interference protrusion comprises:

a rack interference portion configured to interfere with the cutout portion of the tub; and a rack slide portion inclined with respect to a radial direction of the door rack;

wherein the cutout portion of the tub comprises:

a tub interference portion configured to interfere with the rack interference portion to prevent the door from rotating in the second direction; and a tub slide portion inclined to come into contact with the rack slide portion and allowing the door to rotate in the first direction.

7. The dishwasher of claim 1, further comprising:

an inputter configured to receive a user command;

a water spray nozzle configured to spray water into the washing chamber, and including a nozzle valve to regulate an amount of the water spray;

a steam nozzle connected to a pump, and configured to spray steam into the washing chamber; and a processor configured to control the nozzle valve and the pump based on the user command received from the inputter.

8. The dishwasher of claim 7, wherein the user command includes an operation start command, wherein the processor is further configured to control the driver to transmit the rotational force in the first direction to the door based on the operation start command.

9. The dishwasher of claim 7, further comprising a hall sensor to detect a position of the door, and wherein the processor is configured to:

identify whether the door closes the tub based on an output of the hall sensor, and control the nozzle valve and the pump to perform a washing process that alternates between a water spraying cycle and a steam spraying cycle in response to the closing of the door.

10. The dishwasher of claim 9, wherein the processor is further configured to control the driver to transmit the rotational force in the second direction to the basket during the water spraying cycle and the steam spraying cycle.

11. The dishwasher of claim 9, wherein the processor is further configured to:

control the nozzle valve to open the water spray nozzle for a first time in response to the closing of the door, and control the nozzle valve and the pump to alternate between the water spraying cycle and the steam spraying cycle after the first time has elapsed.

12. The dishwasher of claim 11, further comprising a heater connected to the pump;

wherein the processor is further configured to control the heater to allow a temperature of the heater to reach a set temperature before the first time elapses.

13. The dishwasher of claim 11, wherein the processor is further configured to:

control the nozzle valve to close the water spray nozzle after the first time has elapsed, and control the pump to perform the steam spraying cycle for a second time based on the closing of the water spray nozzle.

14. The dishwasher of claim 9, wherein the processor is further configured to end the washing process after the water spraying cycle is performed in response to controlling the nozzle valve and the pump to perform the washing process.

15. The dishwasher of claim 9, wherein the processor is further configured to determine the number of alternating times of the water spraying cycle and the steam spraying cycle based on operation time information received through the inputter.

* * * * *